US007237594B2

(12) United States Patent
Czerwinski

(10) Patent No.: US 7,237,594 B2
(45) Date of Patent: Jul. 3, 2007

(54) NEAR LIQUIDUS INJECTION MOLDING PROCESS

(75) Inventor: Frank Czerwinski, Bolton (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 93 days.

(21) Appl. No.: 11/273,650

(22) Filed: Nov. 14, 2005

(65) Prior Publication Data

US 2006/0096734 A1 May 11, 2006

Related U.S. Application Data

(63) Continuation-in-part of application No. 10/985,879, filed on Nov. 10, 2004.

(51) Int. Cl.
*B22D 17/00* (2006.01)

(52) U.S. Cl. ..... 164/113; 164/900

(58) Field of Classification Search ..... 164/113, 164/900

See application file for complete search history.

(56) References Cited

U.S. PATENT DOCUMENTS

| | | | |
|---|---|---|---|
| 4,832,112 | A | 5/1989 | Brinegar et al. |
| 5,040,589 | A | 8/1991 | Bradley et al. |
| 5,701,943 | A | 12/1997 | Young |
| 5,901,778 | A | 5/1999 | Ichikawa et al. |
| 5,979,535 | A | 11/1999 | Sakamoto et al. |
| 6,311,759 | B1 | 11/2001 | Tausig et al. |
| 6,494,703 | B2 | 12/2002 | Kestle et al. |
| 6,619,370 | B2 | 9/2003 | Sakamoto et al. |
| 6,808,679 | B2 | 10/2004 | Pekguleryuz et al. |
| 6,860,314 | B1 | 3/2005 | Koide et al. |
| 2003/0041998 | A1 | 3/2003 | Suzuki et al. |
| 2003/0230392 | A1 | 12/2003 | Czerwinski et al. |
| 2004/0055726 | A1 | 3/2004 | Hong et al. |
| 2004/0055727 | A1 | 3/2004 | Hong et al. |
| 2004/0055734 | A1 | 3/2004 | Hong et al. |
| 2004/0055735 | A1 | 3/2004 | Hong et al. |
| 2004/0099351 | A1 | 5/2004 | de Figueredo |
| 2004/0173337 | A1 | 9/2004 | Yurko et al. |
| 2004/0261970 | A1 | 12/2004 | Withers |
| 2005/0133188 | A1 | 6/2005 | Fick et al. |

OTHER PUBLICATIONS

Yurko et al., "Thixocasting of a near-liquid cast Al-Mg based Alloy", Journal of Materials Science Letters, 18 (1999), pp. 1869-1870.

Czerwinski, "Injection Molding of Magnesium Alloys", Tech Spotlight, Advanced Materials and Processes, Nov. 2002.

(Continued)

*Primary Examiner*—Len Tran

(57) ABSTRACT

An injection-molding process for molding a metal alloy into a near net shape article that is characterized in that the processing temperature of the alloy at injection is approaching the liquidus, preferably having a maximum solids content of 5%, whereby a net-shape molded article can be produced that has a homogeneous, fine equi-axed structure without directional dendrites, and a minimum of entrapped porosity. Advantageously, the resulting solid article has optimal mechanical properties without the expected porosity and solidification shrinkage attributed to castings made from super-heated melts. Also disclosed is a metal-matrix composite including a metallic component, and also including a reinforcement component embedded in the metallic component, the metallic component and the reinforcement component molded, at a near-liquidus temperature of the metallic component, by a molding machine.

14 Claims, 23 Drawing Sheets

OTHER PUBLICATIONS

"Thixotropic Molding: Semisolid Injection Molding of Magnesium Alloys", Magnesium and Magnesium Alloys, ASM Speciality Handbook, May 1999.

"Assessing capabilities of Thixomolding System in Semisolid Processing Magnesium Alloys", Int.'l Journal of Cast Metals Research, 2003 vol. 16 No. 4 389.

Czerwinski, "On the Generation of Thixotriopic Structures During Melting of Mg-9% Al-1% Zn Alloy", Acta Materialia 50 (2002), pp. 3265-3281.

Xia et al., "Liquidus Casting of a Wrought Aluminum Alloy 2618 for Thixoforming", Materials Science Engineering A246 (1998) pp. 1-10.

Czerwinski, "The Generation of Mg-Al-Zn Alloys by Semisolid State Mixing of Particulates Precursors", Materialia 52 (2004), pp. 5057-5069.

International Search Report for PCT/CA2005/001707, dated Feb. 15, 2006, six pages, related to the parent application for the above-identified US patent application.

NEAR LIQUIDUS INJECTION MOLDING PROCESS

CROSS-REFERENCE TO RELATED APPLICATIONS

This application is a continuation-in-part, claims priority to and the benefit of pending U.S. Ser. No. 10/985,879, filed on Nov. 10, 2004, entitled NEAR LIQUIDUS INJECTION MOLDING PROCESS.

FIELD OF INVENTION

This invention relates to an injection molding process for making near net-shape metal articles and in particular, relates to thin-walled metal articles made from metallic alloys, particularly light metals.

BACKGROUND OF THE INVENTION OF THE INVENTION

In conventional casting, the metal is superheated above its liquidus temperature (i.e. the liquidus being the temperature above which the alloy is completely liquid). A minimum superheat is required to ensure that the metal does not solidify prematurely, particularly when molding thin-walled molded articles. Superheating metals which are prone to oxidation has attendant process control challenges to provide and maintain an inert atmosphere.

Articles which are cast from superheated melts often are not sound in that shrinkage porosity and entrapped gases are not uncommon. In addition, their mechanical properties such as tensile strength, yield stress, and elongation suffer, and this is attributed to a microstructure characterized by coarse grains and dendrites.

These problems have been recognized and extensive work has been done to find other ways of processing metal alloys to improve the mechanical properties of cast articles. In particular, through the use of well known semi-solid metal processing techniques molded articles may be produced with much higher mechanical properties as a result of the generation of a favorable alloy microstructure and by reductions in alloy porosity. Moreover, semi-solid processing techniques provide further advantages in that the relatively low temperature of the alloy slurry provides for a longer useful life of the mold than the die-casting method (e.g. lower thermal shock, and reduced amount of liquid-metal corrosion caused by processing fully molten metals), and improved molding accuracy of the molded article. Common semi-solid processing techniques include semi-solid injection molding, rheocasting, and thixoforming.

Semi-solid injection molding (SSIM) is a metals-processing technique that utilizes a single machine for injecting alloys in a semi-solid state into a mold to form an article of nearly net (final) shape. SSIM involves the steps of partial melting of an alloy material by the controlled heating thereof to a temperature between the liquidus and the solidus (i.e. the solidus being the temperature below which the alloy is completely solid) and then injecting the slurry into a molding cavity of an injection mold. SSIM avoids the formation of dendritic features in the microstructure of the molded alloy, which are generally believed to be detrimental to the mechanical properties of the molded article. The structure and steps of SSIM are described in more detail with reference to the description of the preferred embodiment of the present invention provided hereinafter and with reference to U.S. Pat. No. 6,494,703, the disclosure of which is herein incorporated by reference.

By contrast, rheocasting refers to a process of manufacturing billets or molded articles through casting or forging semi-solid metallic slurries having a predetermined viscosity. In conventional rheocasting, molten alloy is cooled from a superheated state and stirred at temperatures below the liquidus to convert dendritic structures into spherical particles suitable for rheocasting, for example, by mechanical stirring, electromagnetic stirring, gas bubbling, low-frequency, high-frequency, or electromagnetic wave vibration, electrical shock agitation, etc.

Thixocasting refers to a process involving reheating billets manufactured through rheocasting back into a metal slurry and casting or forging it to manufacture final molded articles.

For instance, U.S. Pat. No. 5,901,778 describes an improved rheocasting method and extruder apparatus for producing a semi-solid metal alloy slurry having a solids content between 1 and 50% that is characterized by structure and steps whereby molten metallic alloy material is introduced into an agitation chamber, that is heated about 100 degree C higher than a liquidus temperature of the molten metallic material, wherein the alloy is cooled and agitated by a cooled screw-shaped stirring rod, having a temperature below a temperature of the semi-solid, to produce the semi-solid slurry.

U.S. patent application Ser. No. 2004/0173337 describes an improved rheocasting method and apparatus for producing a non-dendritic, semi-solid metal alloy slurry having a solids content of about 10% to about 65% that is characterized by structure and steps whereby problems associated with accumulation and removal of metal from surfaces of the apparatus contacting the slurry are reduced or eliminated.

U.S. patent application Ser. No. 2004/0055726 describes a rheocasting method and apparatus for die casting molded articles that is characterized by structure and steps for applying an electromagnetic field to stir a molten metal as it is being loaded into a slurry forming portion of a shot sleeve whereby the slurry is stirred until cooled below its liquidus temperature prior to its transfer to a casting portion of the shot sleeve. Preferably, the stirring is maintained until the slurry achieves a solid fraction in the range of 0.1 to 40%, alternatively the slurry is stirred until the solid fraction is in the range of 10 to 70%. Related U.S. patent applications Ser. Nos. 2004/0055727, 2004/0055734, and 2004/0055735 describe similar structure and steps for manufacturing billets for thixocasting, manufacturing metallic materials for rheocasting or thixoforming, and for manufacturing a semi-solid metallic slurry, respectively.

U.S. Pat. No. 6,311,759 describes a process for producing a feedstock billet material that is characterized in that it is produced from a melt at substantially its liquidus temperature whereby a microstructure of the feedstock is rendered especially suitable for subsequent thixocasting in the semi-solid range of 60 to 80% primary solids. This patent is significant in that it recognizes that metal alloys cast from at a near liquidus temperature will result in a favorable grain structure characterized by primary grains that are equi-axed and globular with no dendrites.

The process of SSIM is however generally preferred as it provides for several important advantages relative to the other semi-solid processing techniques. The benefits of SSIM include an increased design flexibility of the final article, a low-porosity article as molded (i.e., without subsequent heat treatment), a uniform article microstructure, and articles with mechanical and surface-finish properties that are superior to those made by conventional casting.

Also, because the entire process takes place in one machine and in an ambient environment of inert gas (e.g., argon), alloy evaporation and oxidation can be nearly eliminated. The SSIM process also provides for energy savings in that it does not require the heating of the alloy above its liquidus temperature.

Although a 5-60% solids content is generally understood to be the working range for SSIM, it is also generally understood that practical guidelines recommend a range of 5-10% solids for injection molding thin-walled articles (i.e., articles with fine features) and 25-30% for articles with thick walls. The foregoing is described in U.S. Pat. No. 5,040,589.

Notwithstanding the foregoing, a recently published discovery by the inventor of the present invention has shown that the range of percentage of solids in SSIM processing can be advantageously extended into an ultra-high solids range between 60 and 85%. The foregoing ultra-high solids process is fully described in commonly assigned U.S. patent application Ser. No. 2003/0230392.

The lower limit of 5% solids fraction has been sustained by those skilled in the art because of a belief that to lower the solids fraction any further would obviate any advantages achieved by semi-sold processing. In particular, with a low or non-existent solids content, the fluidity of the alloy is expected to increase, resulting in an increase in turbulence in the flow front thereof as the molding cavity is being filled, and thereby increasing the likelihood of porosity and entrapped gases in the final article.

Notwithstanding the foregoing, it is known to configure structure and steps for SSIM processing with a percentage of solids as low as 2% under certain conditions.

For instance, U.S. Pat. No. 5,979,535 describes a method for injection molding a molded article having both lower and higher solid fraction portions therein, the method characterized in that structure and steps are provided for establishing a temperature distribution in the semi-molten slurry in the direction of injection, by the controlled heating thereof in an extruder cylinder, whereby the slurry contemporaneously includes a low and a high solids fraction portions for sequential injection into the molding cavity. In a cited example, an orifice holder is molded in which a high strength head portion is formed from a melt portion having about 2% solids whereas a more accurately molded threaded portion is formed from a melt portion having about 10% solids.

However, the molding of thin-walled molded articles, particularly those having a thickness below 2 mm, using SSIM at typical low levels of solids fraction (i.e. 5%) can be problematic because of premature alloy solidification that results from the reduced fluidity of the alloy metal, relative to die casting, and because of the high thermal conductivity of typical molding alloys (e.g. Magnesium alloy AZ91D).

U.S. Pat. No. 6,619,370 is directed at solving the problems of molding thin-walled molded articles using SSIM. In particular, structure and steps are provided for increasing the fluidity of the semi-molten melt and for providing increased degassing of the molding cavity. It is stated therein that the solid fraction of the semi-molten metal slurry must be set within a range exceeding 3% and below 40% to avoid excessive warping of the thin-walled molded article.

However, it remains a challenge to produce thin-walled molded articles using SSIM without resort to significant overheating of the alloy above the liquidus temperature and the resulting reduction in mechanical properties.

Accordingly, an advantage of the present invention is that an injection molding process is provided for producing thin-walled metal articles with improved structural integrity and superior mechanical properties relative to those produced by traditional casting methods.

SUMMARY OF THE INVENTION

In accordance with an aspect of the present invention, an injection-molding process is provided for molding a metal alloy into a near net shape article in which the processing temperature of the alloy is approaching its liquidus, preferably having a maximum solids content of 5%, whereby a net-shape molded article can be produced that has a homogeneous, fine equi-axed structure without directional dendrites, and a minimum of entrapped porosity.

Advantageously, the resulting solid article has optimal mechanical properties without the expected porosity and solidification shrinkage attributed to castings made from super-heated melts.

In accordance with another aspect of the present invention, an injection-molding process is provided for molding a metal alloy into a near net shape article in which the processing temperature of the alloy is approaching its liquidus, preferably having a maximum solids content of 2%, whereby a net-shape molded article can be produced that has a homogeneous, fine equi-axed structure without directional dendrites, and a minimum of entrapped porosity.

In accordance with a preferred embodiment of the present invention the magnesium alloy AZ91D is to be processed at a temperature range of within 2° C., preferably below, its liquidus temperature. The target liquidus temperature itself may need to be ascertained by trial and error to adjust for composition changes in the feed alloy, and changing heat transfer conditions between the barrel and the melt. For a nominal composition of the Az91D alloy, the alloy is to be heated in the barrel to a processing temperature approaching 595° C.

In accordance with an alternative embodiment of the present invention the magnesium alloy AM60B is to be processed at a temperature range of within 1° C., preferably below, its liquidus temperature. The target liquidus temperature itself may need to be ascertained by trial and error to adjust for composition changes in the feed alloy, and changing heat transfer conditions between the barrel and the melt. For a nominal composition of the AM60B alloy, the alloy is to be heated in the barrel to a processing temperature approaching 615° C.

The invention finds application to the fabrication of thin-walled articles such as casings for laptop computers, video recorders and cell phones made from light metal alloys. Magnesium based alloys are of particular interest because of their superior strength to weight ratio, stiffness, electrical conductivity, heat dissipation and absorption of vibrations.

According to another aspect of the present invention, there is provided a metal-matrix composite, including a metallic component, and also including a reinforcement component embedded in the metallic component, the metallic component and the reinforcement component molded, at a near-liquidus temperature of the metallic component, by a molding machine.

According to yet another aspect of the present invention, there is provided a molded article, including a metallic component molded, at a near-liquidus temperature of the metallic component.

BRIEF DESCRIPTION OF THE DRAWINGS

In order to better understand the invention, a preferred embodiment is described below with reference to the accompanying drawings, in which.

DETAILED DESCRIPTION OF THE EXEMPLARY EMBODIMENTS

Figure 1:
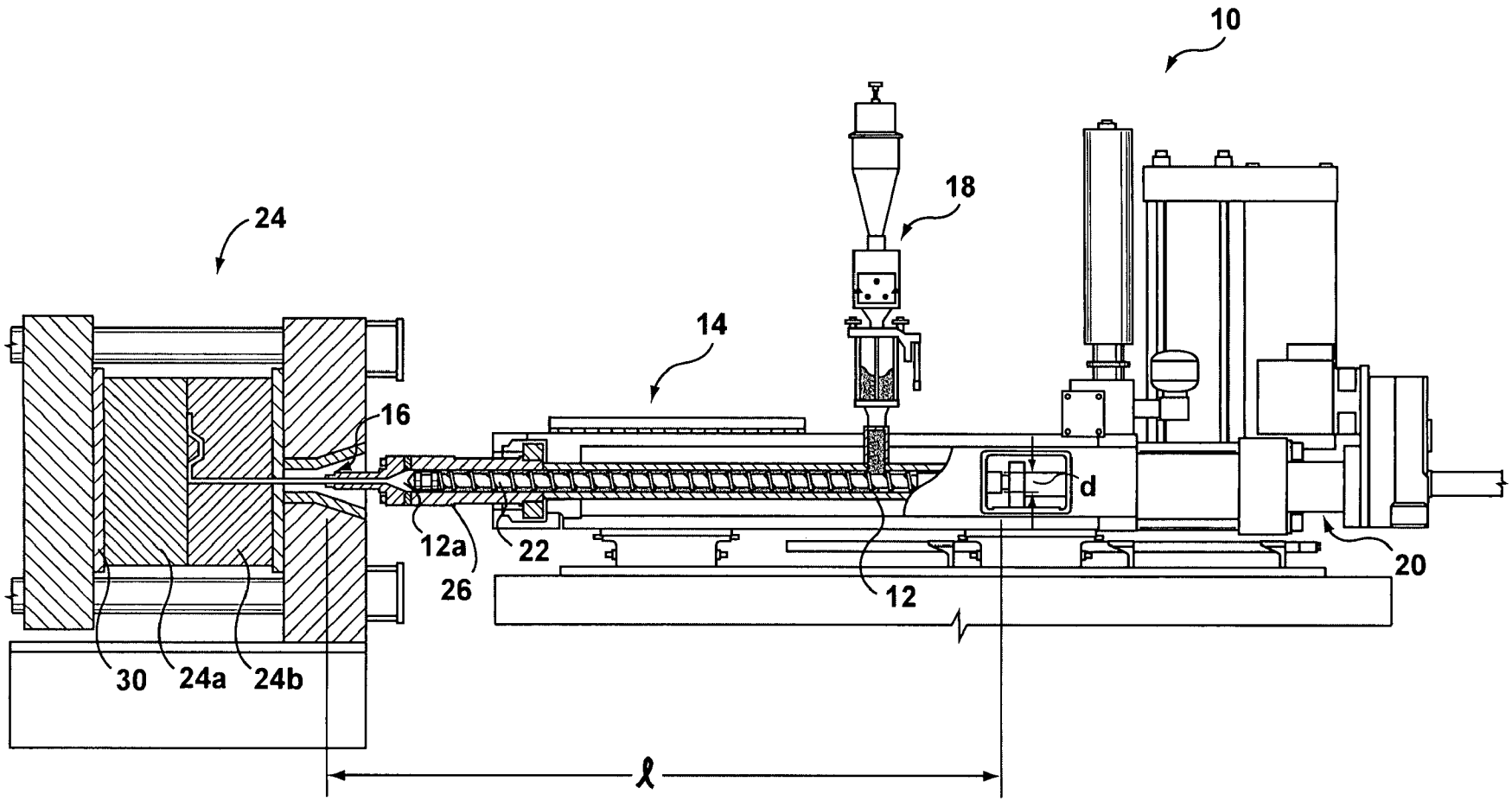
FIG. 1 is a schematic showing an injection-molding apparatus used in an embodiment of the present invention.

FIG. 1 schematically shows an injection-molding apparatus 10 used to perform the process according to the present invention. The apparatus 10 includes a barrel assembly comprising a cylindrical barrel portion 12 with a barrel head portion 12*a* arranged at a distal end thereof, and a machine nozzle portion 16 opposite thereto, a contiguous melt passageway being arranged through said barrel assembly. The barrel portion 12 is configured with a diameter d of 70 mm and a length l of approximately 2 m. A temperature profile along the barrel assembly is maintained by electrical resistance heaters 14 grouped into independently controlled zones along the barrel portion 12, including along the barrel head portion 12*a* and the nozzle portion 16. According to a preferred embodiment, the apparatus 10 is a Husky™ TXM500-M70 system whereby the temperature of the alloy in the head portion 12*a* may be controlled within 2° C. of the liquidus temperature and even within 1° C. thereof.

Solid chips of alloy material are supplied into the melt passageway of the barrel assembly through a feeder apparatus 18. The alloy chips may be produced by any known technique, including mechanical chipping or rapidly solidified granules. The size of the chips is approximately 1-3 mm. A rotary drive portion 20 turns a retractable screw portion 22 that is arranged in the melt passageway of the barrel portion 12 to transport the alloy material therealong.

Figure 2:
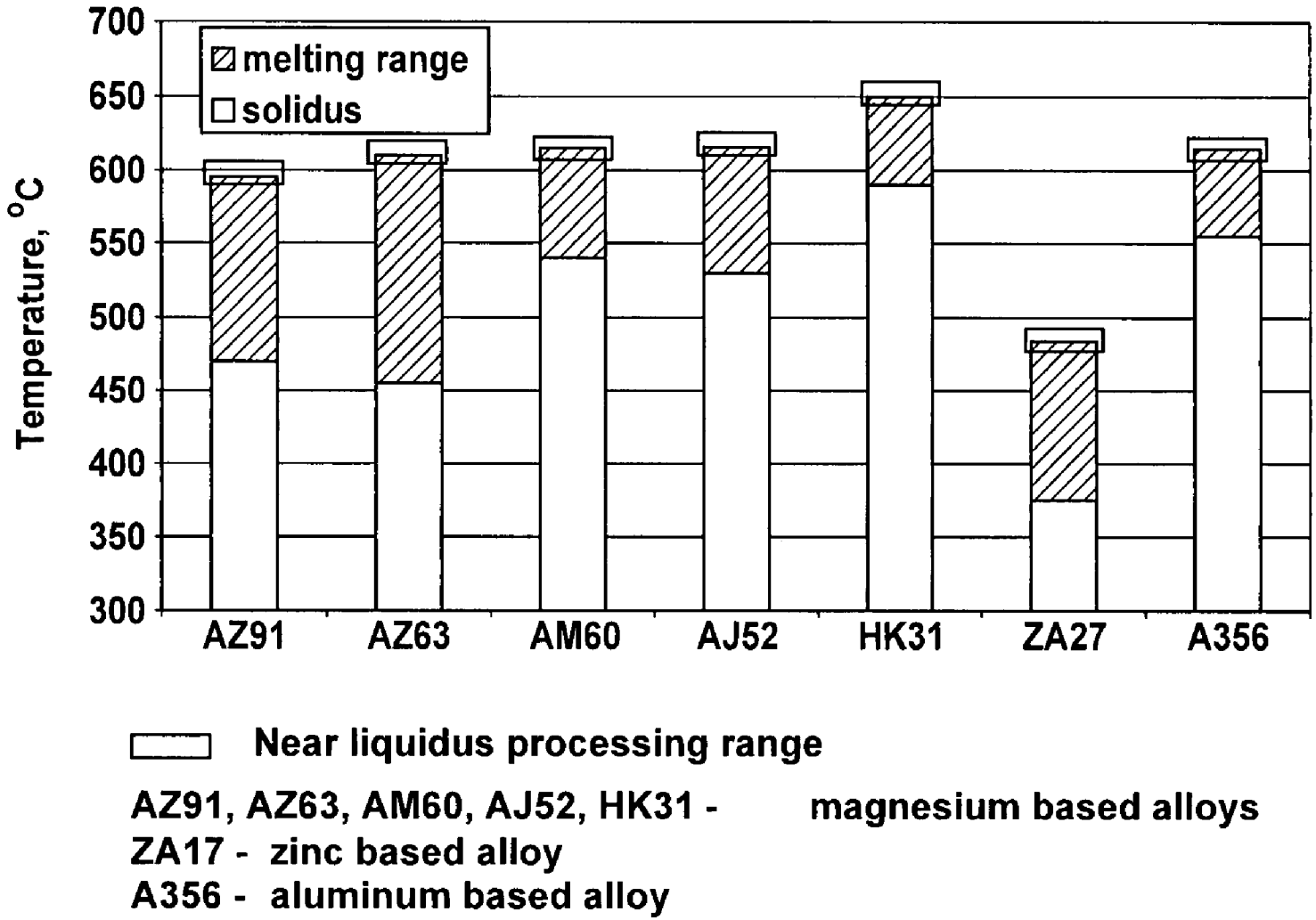
FIG. 2 is a graphical representation showing the near liquidus processing temperature range of alloys having a liquidus below 700° C.

Experiments were conducted using two commercial die cast alloys Az91D and AM60B whose nominal compositions are shown in Table 1. Another suitable alloy is AJ52 (Mg—5Al—1.5Sr) as described in U.S. Pat. No. 6,808,679 that has a nominal liquidus temperature of 616° C. It should be understood, however, that the present invention is not limited to the injection molding of magnesium alloys but is also applicable to injection molding of other alloys, including Al alloys and other alloys such as lead based alloys, zinc based alloys, and bismuth based alloys. FIG. 2 is a graphical representation showing the liquidus processing temperature range of several presently preferred alloys.

TABLE 1

Chemical compositions of AZ91D and AM60B alloys processed by injection molding and die casting. Analysis was performed according to ASTM E1097-97 modified and E1479-99 standards. All values are in weight %.

| Processing technique | Alloy grade | Al | Zn | Mn | Si | Cu | Fe | Ni | Mg |
|---|---|---|---|---|---|---|---|---|---|
| Near liquidus molding | AZ91D | 8.69 | 0.66 | 0.29 | 0.02 | <0.01 | <0.01 | <0.01 | base |
| | AM60B | 5.82 | <0.01 | 0.31 | 0.03 | na | <0.01 | <0.01 | base |
| Superheated liquid die casting | AZ91D | 8.70 | 0.58 | 0.24 | 0.017 | 0.0031 | 0.0021 | 0.0009 | base |
| | AM60B | 6.00 | 0.008 | 0.27 | 0.017 | 0.0021 | 0.0006 | 0.0007 | base |

Figure 3:
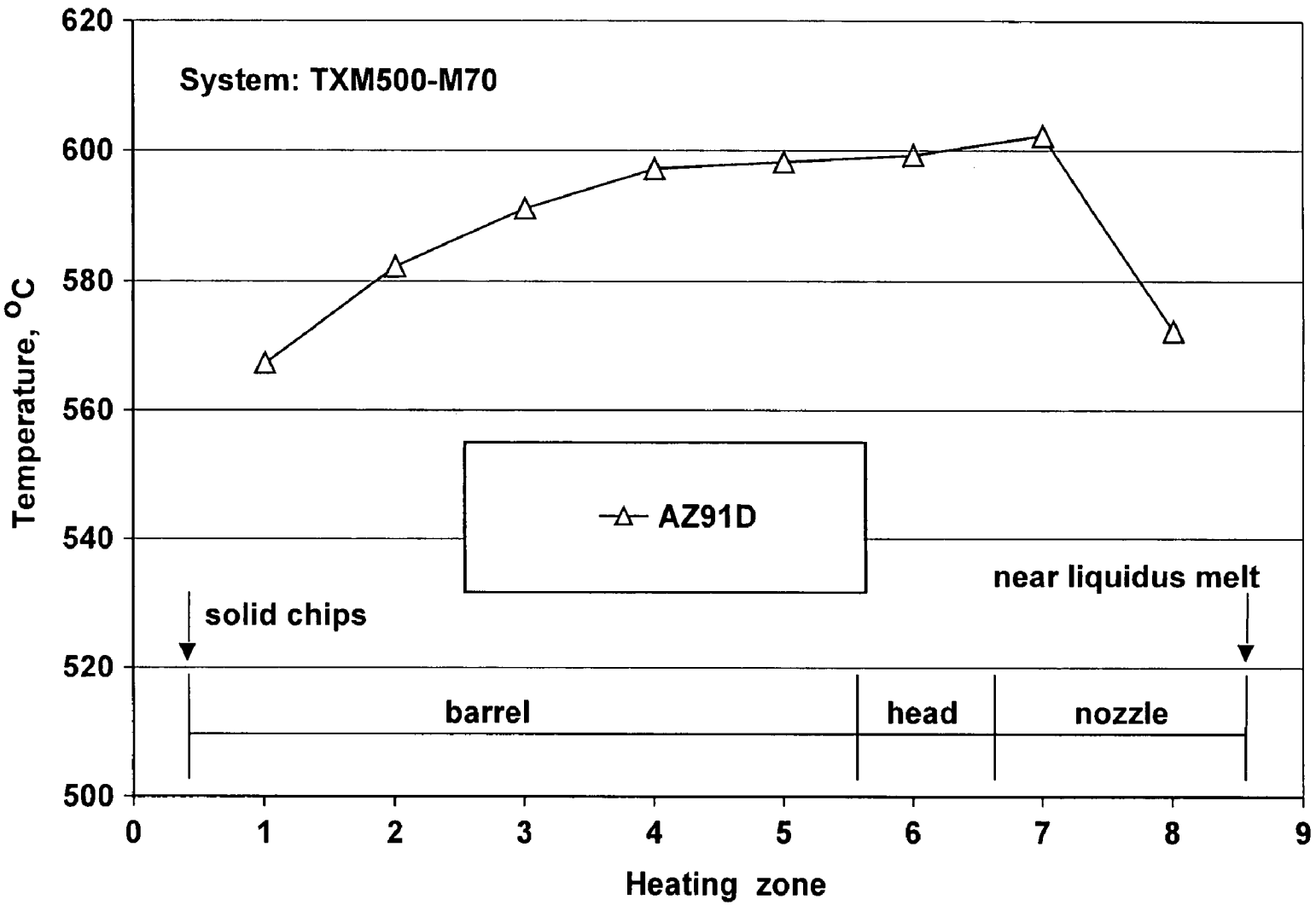
FIG. 3 is a chart of a temperature distribution along a barrel portion of the injection-molding apparatus of FIG. 1 during a near liquidus processing of a magnesium alloy AZ91D.

In accordance with a preferred near liquidus molding process of the present invention, the heaters 14 are controlled by microprocessors (not shown) programmed to establish a precise temperature distribution within the barrel portion 12 that heats the alloy in the melt passageway of the barrel assembly to a temperature approaching its liquidus so that the solids fraction is preferably 0% but not over 5%. FIG. 3 shows an example of a temperature distribution in the barrel portion 12 for achieving liquidus temperature of 595° C. for a AZ91D alloy.

Motion of the screw portion 22 acts to mix the alloy as it is being melted and to convey the melt past a non-return valve 26, mounted at a distal end of the screw, for accumulation of the melt in a forward portion of the melt passageway, a so-called "accumulation portion" of the barrel. The non-return valve 26 prevents the melt from squeezing backwards into the barrel portion 12 during injection.

The internal portions of the apparatus 10 are kept in an inert gas surrounding to prevent oxidation of the alloy material. An example of a suitable inert gas is argon. The inert gas is introduced via the feeder 18 into the apparatus 10, which prevents the back-flow of air. Additionally, a plug of solid alloy, is formed in the nozzle portion 16 after injection. The plug is expelled when the next shot of alloy is injected and is captured in a sprue post portion of the mold 24.

The rotary drive portion 20 is controlled by a microprocessor (not shown) programmed to reproducibly transport each shot of alloy material through the barrel portion 12 at a set velocity, so that the residence time of each shot in the different temperature zones of the barrel portion 12 is precisely controlled, thus reproducibly minimizing the solids content of each shot to ensure that it does not exceed a 5% solids fraction.

Experiments were conducted in accordance with the invention to apply the injection molding technique for the net-shape forming of Mg—9Al—1Zn and Mg—6Al particulates, after preheating to near-liquidus ranges, and assess the microstructural and tensile characteristics of the solidified alloys. As a comparison base, the same alloy grades were used after processing from a superheated liquid by conventional die-casting.

EXPERIMENTAL DETAILS

During injection molding, the feedstock, in the form of mechanically comminuted chips, was processed in a Husky TXM500-M70 system with a clamp force of 500 tons and equipped with a tensile bar mold. The total weight of the four cavity shot was 250.3 g, including 143.7 g of sprue with runners and 35 g of overflows. Upon accumulating the required shot size in front of the non-return valve, the screw was accelerated forward to 2.2 m/s, injecting the alloy through the sprue and gates with an opening area of 64.8 $mm^2$ into the mold cavity, preheated to 200° C. After the mold 24 is filled with the slurry, the slurry may undergo a final densification, in which pressure is applied to the slurry for a short period of time, typically less than 10 ms, before the molded article is removed from the mold 24. The final densification is believed to reduce the internal porosity of the molded article.

The alloys with nominally the same chemistries were also processed into tensile bars using a Bueler Evolution 420D high-pressure die casting machine at Hydro Research Park, Porsgrunn, Norway. The die was preheated to 200° C. and the temperatures of AZ91D and AM60B melts were 670° C. and 680° C., respectively.

Tensile testing was conducted according to ASTM B557 using cylindrical samples with a reduced section diameter of 6.3 mm for molding and 5.9 mm for die casting, and a gauge length of 50.8 mm. Measurements were performed using an Instron 4476 machine equipped in an extensometer at a crosshead speed of 0.5 mm/min. Tensile curves were analyzed to assess the ultimate tensile strength, yield strength and elongation. The chemical compositions were determined with inductive coupled plasma spectrometry according to ASTM E1097-97 modified and E1479-99 specifications. Cross sections for optical microscopy observations were prepared by polishing down to 0.05 μm de-agglomerated alumina powder. To reveal microstructure, surfaces were etched with 1% nital. Moreover, an etching was used to show differences in crystallographic orientations of individual grains. The stereological parameters of selected microstructures were measured using the quantitative image analyzer. The structural details were imaged with scanning electron microscopy (SEM) and the microchemistry was measured with an X-ray microanalyzer (EDAX). X-ray diffractometry with $Cu_{K\alpha}$ radiation was applied for the phase and crystallographic characterizations of materials.

RESULTS

Melting Differences of AZ91 and AM60 Alloys

Figure 4:
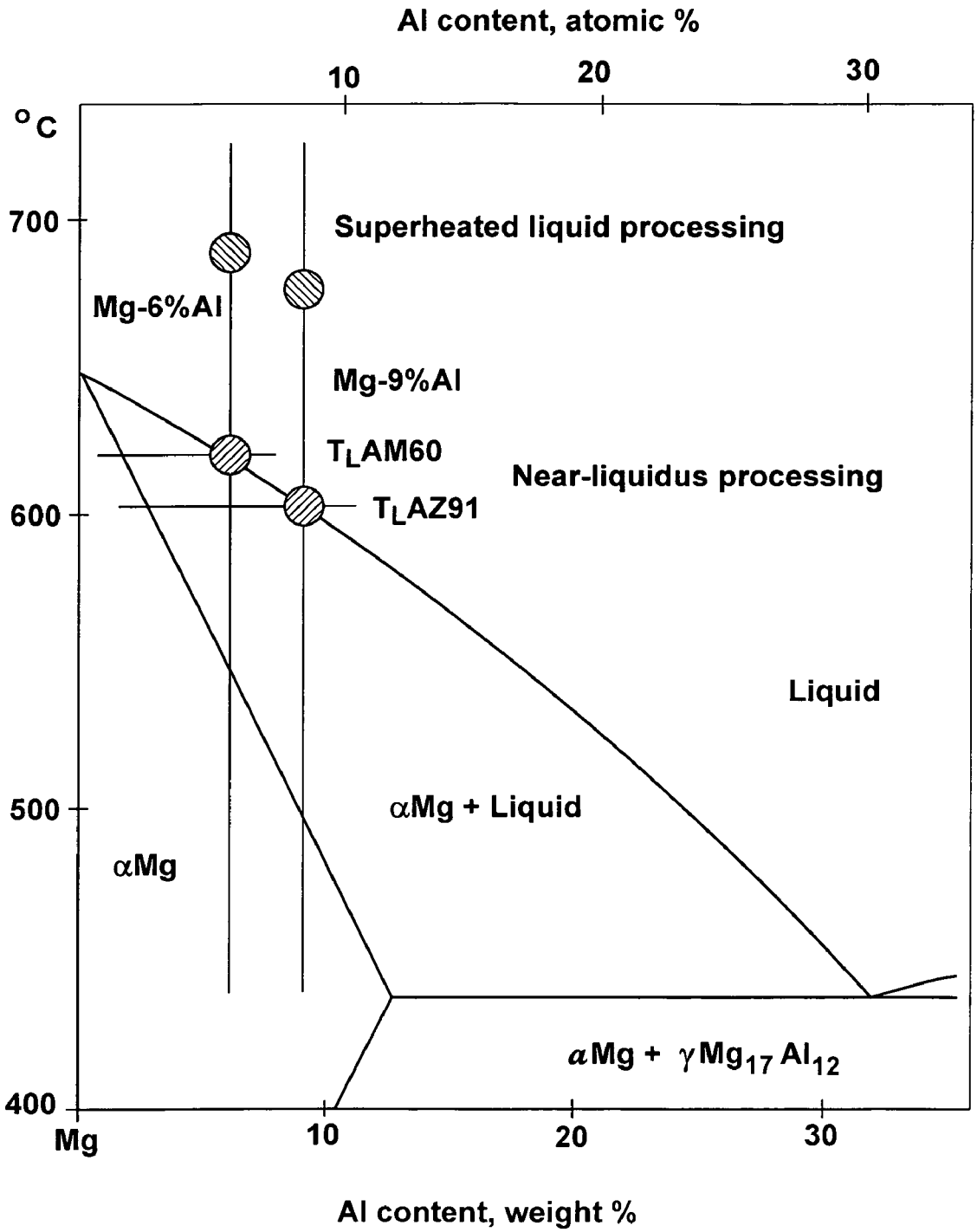
FIG. 4 is a phase diagram with marked chemistries and preheating temperatures of alloys investigated.

The Mg—rich portion of the binary Mg—Al diagram with the marked locations of examined alloys and processing temperatures is shown in FIG. 4. Due to a deviation from the equilibrium state, both AZ91D and AM60B alloys, under typical solidification conditions, contain the $Mg_{17}Al_{12}$ phase. The phase forms by a eutectic reaction during sufficiently rapid cooling from the liquid as a result of coring. The presence of 1% Zn does not lead to the generation of new phases. According to the ternary phase diagram of Mg—Al—Zn, under equilibrium conditions, up to 4% of Zn, the phases present in ternary Mg—Al—Zn alloys are the same as those known from Mg—Al binary systems. Zinc substitutes some Al in the intermetalllic compound, which extends its formula to $Mg_{17}Al_{11.5}Zn_{0.5}$. If zinc exceeds 4%, a three-phase region is entered involving the ternary intermetallic phase ϕ. This compound leads to an eutectic reaction at a temperature of about 360° C.

Figure 5:
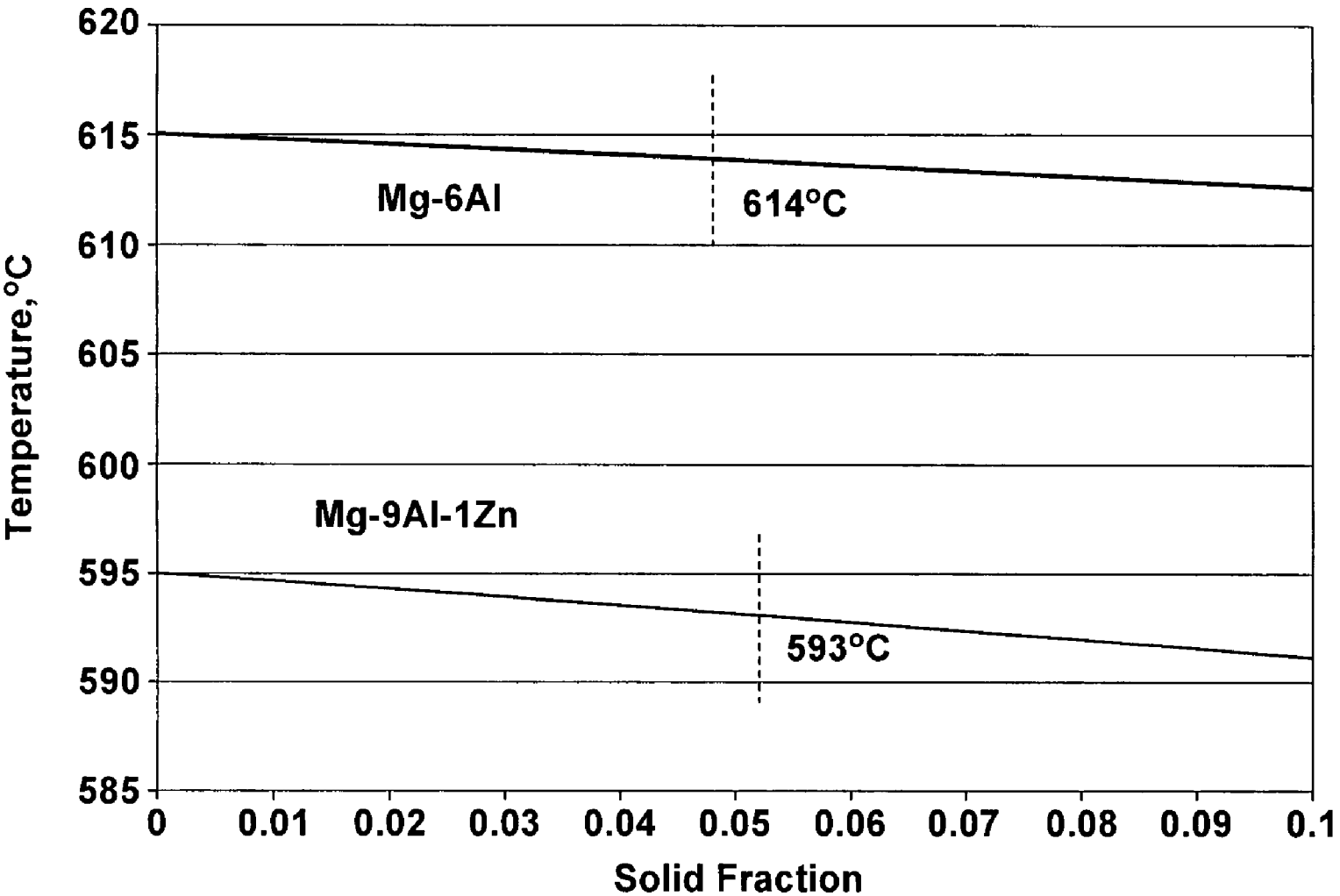
FIG. 5 is a graph of the solid fraction versus temperature for sub-liquidus regions of AZ91 and AZ60 alloys, calculated based on Scheil's formula.

The AZ91D and AM60B alloys exhibit approximately 20° C. difference in their liquidus temperatures of nominally 595° C. and 615° C., respectively. For both chemistries, the specific solid content $f_s$ can be calculated according to Scheil's equation:

$$f_s=1-\{(T_m-T)/(T_m-T_L)\}^{-1/(1-Ko)} \quad (1)$$

where $T_m$ is the melting temperature of pure metal, $T_L$ is the liquidus temperature of the alloy and $K_o$ is the equilibrium distribution coefficient. The results are presented in the form of a graph in FIG. 5. It will be noted that the liquidus temperature of any given alloy varies, to a small degree, according to its chemistry and microstructure. For instance, variations in the content of antioxidants, such as beryllium, or the effect of purification agents, can cause the alloy's liquidus temperature to shift. It is clear that in the sub-liquidus range, very small changes in the temperature result in substantial variations of solid fractions. In accordance with the invention, the solid fraction is maintained below 5%. For AZ91D alloy, an increase in solid fraction from 0 to 5% takes place after reducing the temperature by 2° C. below the liquidus. The alloy of Mg—6% Al is even more sensitive and the same variation in solid content from 0 to 5% requires the 1° C. reduction below the liquidus point. Thus, processing in the sub-liquidus range imposes a challenge on tight temperature control and some experimentation may be required to determine the appropriate barrel temperature profile required. It will be appreciated that there is a "dynamic equilibrium" between the temperature of the barrel assembly, which is evaluated at some distance from the melt passageway extending therethrough, and the actual temperature of the molding material in the barrel melt passageway, and furthermore that the temperature of the molding material is also a function of its flow rate. So, the barrel temperature zone set-points may be higher or lower than the temperature of the molding material in the melt passageway.

Tensile Properties

Figure 6:
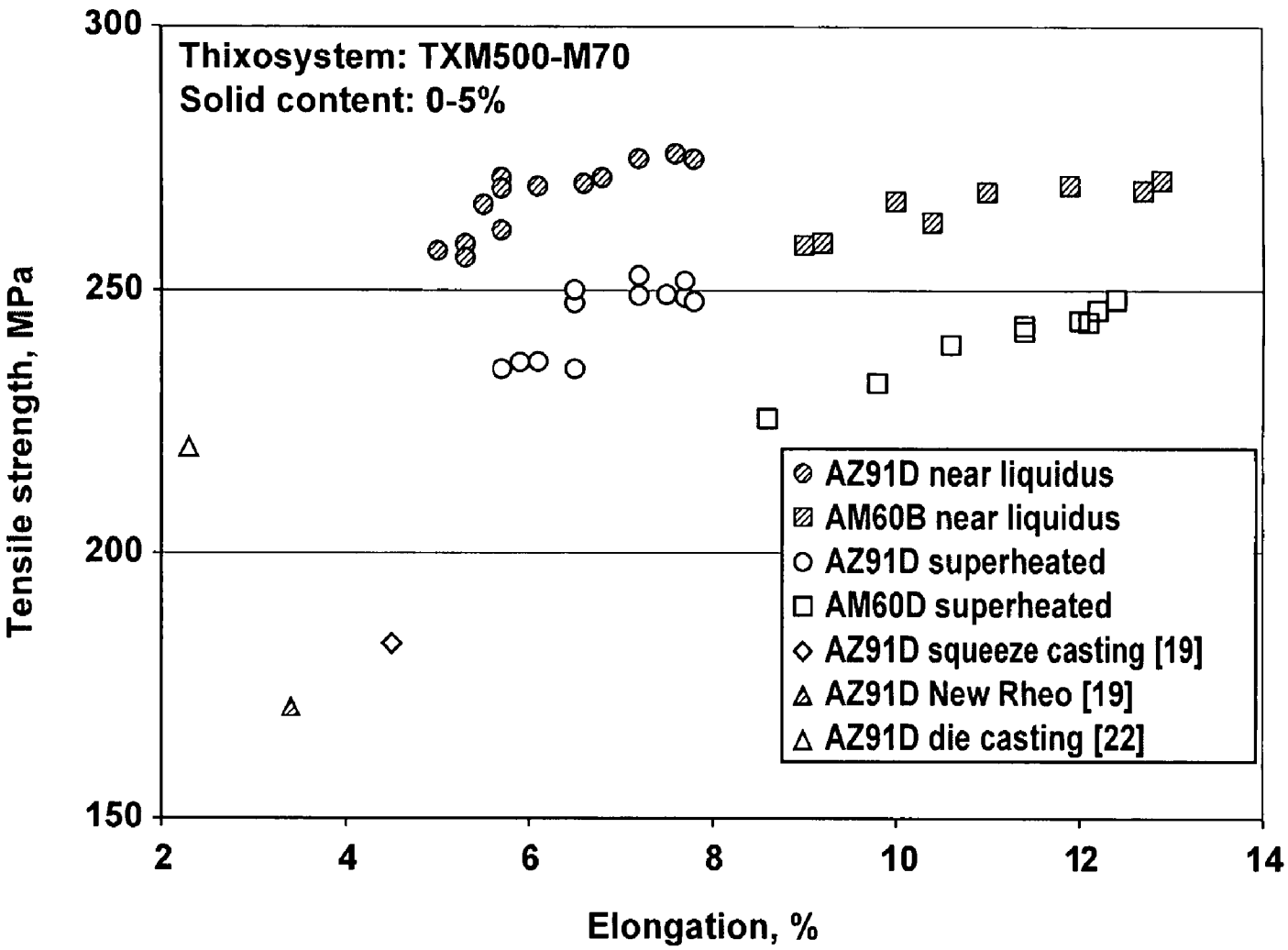
FIG. 6 is a plot of tensile strength versus corresponding elongation for AZ91D and AM60B alloys molded from near liquidus temperatures and die cast from a superheated state. For a comparison, some literature data are included. ASTM B94 Standard requirements: AZ91D: UTS=230 MPa, YS=150 MPa, Elongation=3% in 50.8 mm; AM60B: UTS=220 MPa, YS=130 MPa, Elongation=6% in 50.8 mm.
Figure 7:
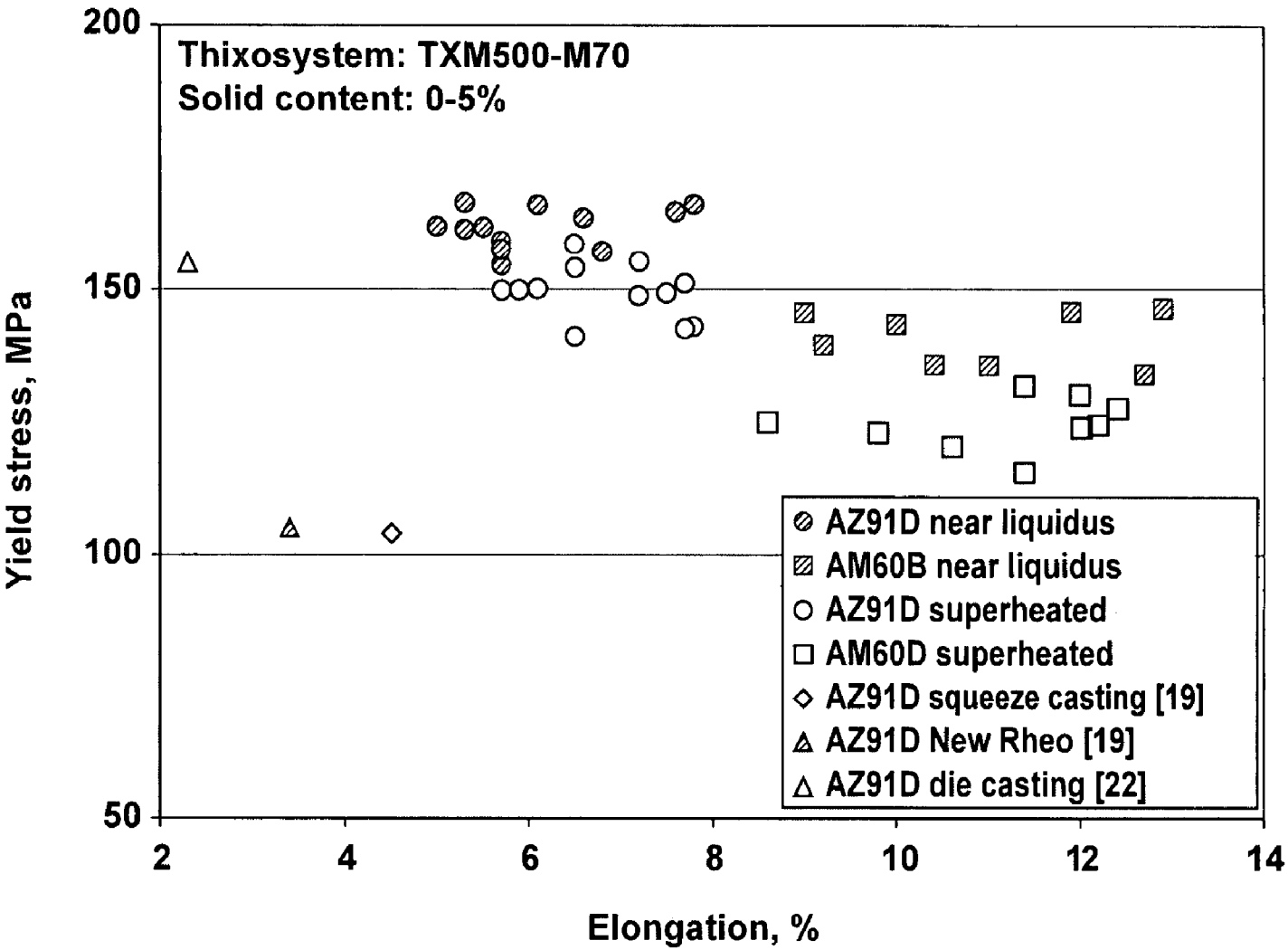
FIG. 7 is a plot of yield stress versus corresponding elongation for AZ91D and AM60B alloys molded from near liquidus temperatures and die cast from superheated state. For a comparison, some literature data are included.

The comparative graph of tensile strength plotted, versus corresponding elongations for both alloys and processing techniques, is shown in FIG. 6. The highest strength of 275 MPa was achieved for the AZ91D alloy, molded from near liquidus temperatures. The AZ91D alloy, which was processed from a superheated liquid exhibited a strength of up to 252 MPa. The strength of AM60B alloy was similar and after molding from its near-liquidus range achieved the maximum value of 271 MPa. Again, after processing from the superheated liquid by die casting, the strength of the AM60B alloy was lower and did not exceed 252 MPa. The elongations achieved for both processing routes were comparable and reached up to 8% for AZ91D and up to 12.5% for AM60B grade. Similar tendencies were revealed for yield stress measured for both alloys and processing routes (FIG. 7). The average values obtained for near-liquidus molding reached 166 MPa and 146 MPa for AZ91D and AM60B, respectively. The average yield stress after die casting was 149 MPa and 124 MPa for AZ91D and AM60B, respectively. It is seen that the tensile-test data, achieved in this study, are significantly higher than that required by the ASTM B94 specification.

There was a scatter of experimental data points for each alloy composition and processing method, with a general tendency of the higher strength corresponding to the higher elongation (FIGS. 6 and 7). For near-liquidus molded alloys, the solid content in 0-5% range was the major variable, contributing to the scatter. Although for superheated alloys, processed by die casting, the same tendency in strength and elongation changes was observed, there was no obvious correlation with microstructural components. In addition to pre-eutectic precipitates of α—Mg dendrites, shrinkage porosity complicated the quantification. In contrast to strength, the larger scatter of yield stress values and limited number of experimental data points did not reveal a correlation between the yield stress and elongation.

Alloy's Structural Integrity

Figure 8A:
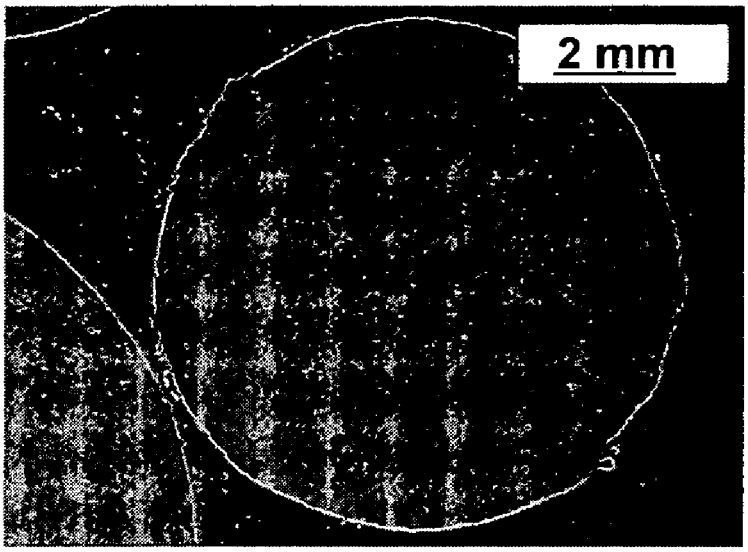
FIG. 8*a* is a macroscopic image, 2 mm across, of a cross section of a tensile bar, formed from a AZ91D alloy after die casting from a superheated state, showing a structural integrity that is devoid of any evident defects.
Figure 8B:
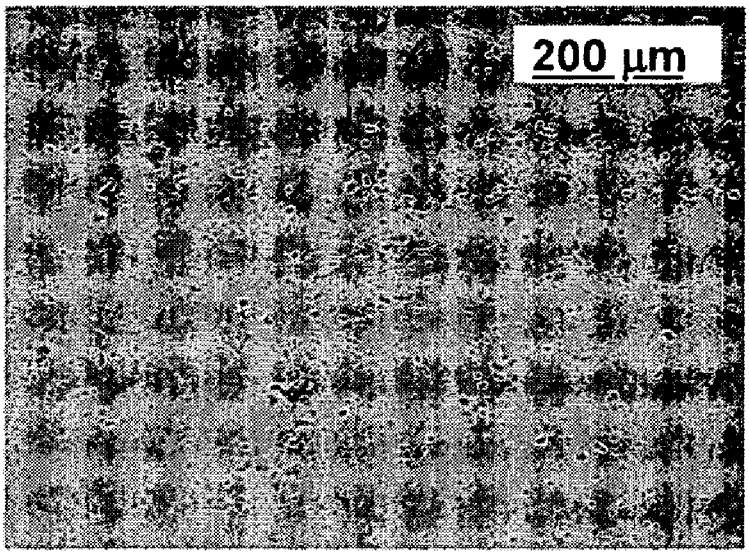
FIG. 8*b* is a microscopic image, 200 μm across, of the cross section of FIG. 8*a* showing a general view of shrinkage porosity.
Figure 8C:
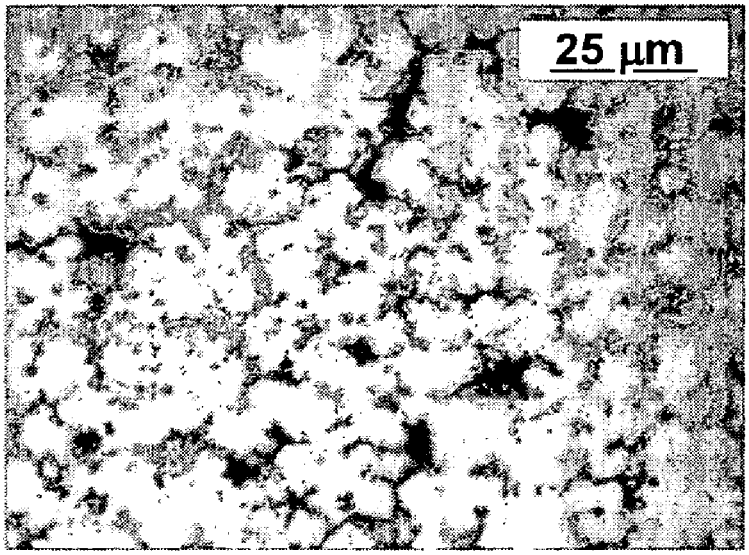
FIG. 8*c* is a detailed microscopic image, 25 μm across, of the cross section of FIG. 8*a* showing a the intercrystalline nature of pores formed during solidification shrinkage.

As factors affecting structural integrity of the alloy, only those defects which are inherent to the given processing method are discussed here. The defects which are associated with incorrect injection and thermal settings or the specific part geometry, are not considered. Due to the very simple geometry of the selected mold (die), virtually no macro porosity occurred in the 5.9 and 6.3 mm sections of tensile bars (FIG. 8*a*). At the same time, however, there was a substantial difference in microstructural integrity after processing from a superheated liquid. Both alloy grades showed shrinkage porosity, according to a metallographic estimation at a level of several percent. The porosity had a form of randomly distributed individual gaps or clusters (FIG. 8*b*). The pores occupied intercrystalline spaces and were surrounded by the last solidified phase, with the lowest melting temperature (FIG. 8*c*). Their typical size was of the order of 10 μm, so they were not easily detectable during macroscopic observations.

Microstructure Development

Figure 9A:
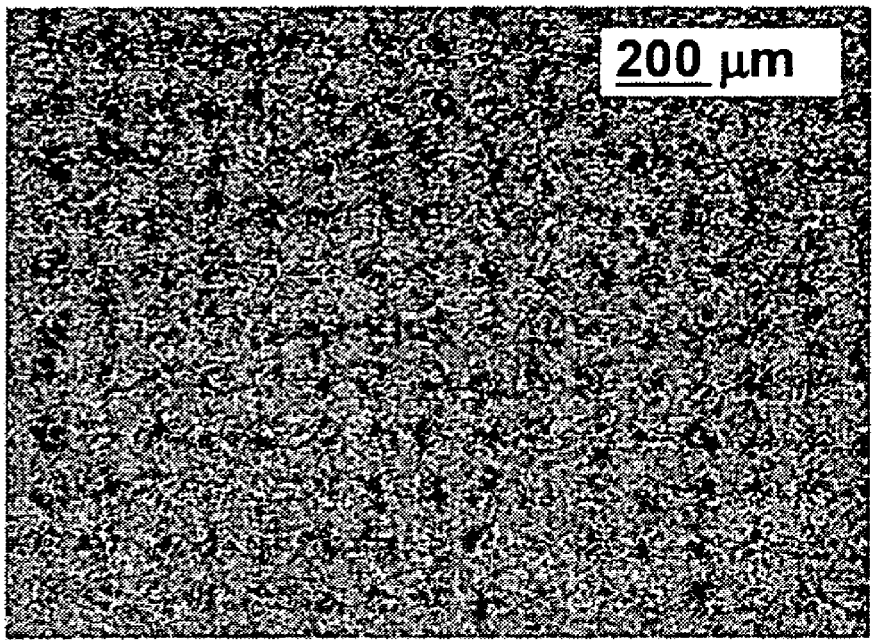
FIG. 9*a* is a microscopic image, 200 μm across, of a cross section of a tensile bar, formed from a AZ91D alloy after injection molding at 0% solid, showing dark spots that represent Mn—Fe—Al intermetallics.
Figure 9B:
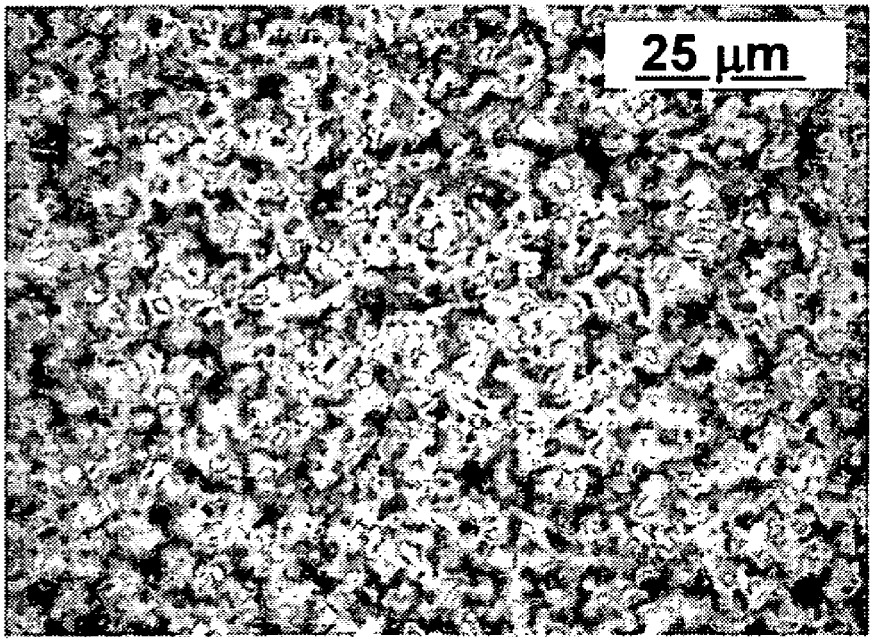
FIG. 9*b* is a detailed microscopic image, 25 μm across, of the cross section of FIG. 9*a* showing segregation within α—Mg and distribution of $Mg_{17}Al_{12}$ intermetallics.

The predominant or exclusive component of microstructures generated during molding in a near-liquidus range was the solidification product of the liquid fraction (FIG. 9*a*). At low magnifications, the microstructure appeared uniform with randomly distributed undissolved Mn—Al—Fe intermetallics and $Mg_2Si$ inclusions, which originated from a metallurgical rectification. Due to their dark contrast, these phases may be misinterpreted as pores. The dominant component represented a divorced eutectic, where discontinuous precipitates of the $Mg_{17}Al_{12}$ compound decorated the boundaries of equi-axed α—Mg regions. At high magnifications, the α—Mg islands, with a size of the order of 20 μm, exhibited a distinct contrast caused by differences in chemistry (FIG. 9*b*).

Figure 10A:
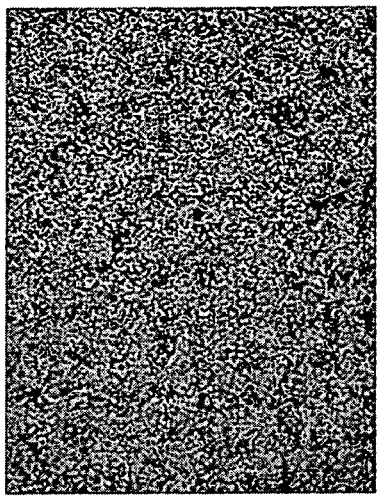
FIG. 10*a* is a microscopic image, 100 μm across, of a cross section of a tensile bar, formed from a AZ91D alloy after injection molding at 0% solid, showing the representative morphology of solids.
Figure 10B:
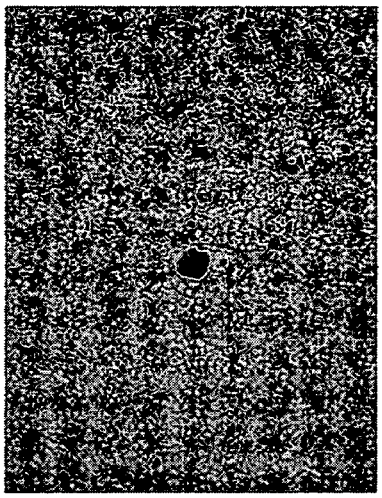
FIG. 10*b* is a microscopic image, 100 μm across, of a cross section of a tensile bar, formed from a AZ91D alloy after injection molding an alloy heated to a sub-liquidus temperature with 1% solid fraction, showing the representative morphology of globular shaped solids.
Figure 10C:
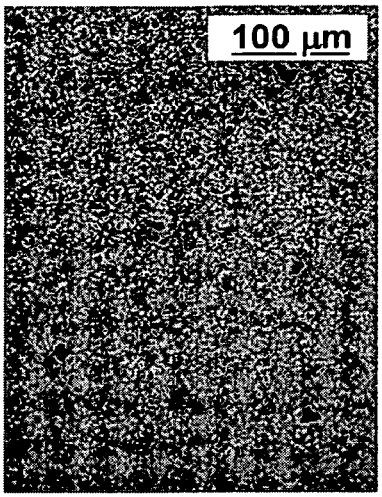
FIG. 10*c* is a microscopic image, 100 μm across, of a cross section of a tensile bar, formed from a AZ91D alloy after injection molding an alloy heated to a sub-liquidus temperature with 2% solid fraction, showing the representative morphology of globular shaped solids.
Figure 10D:
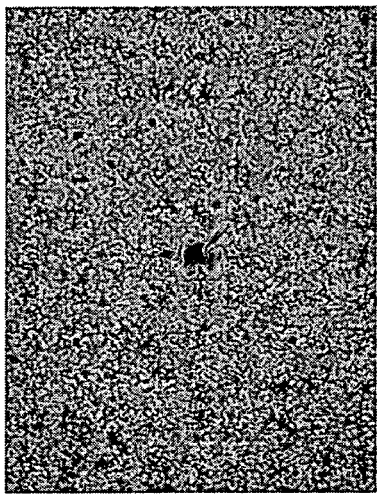
FIG. 10*d* is a microscopic image, 100 μm across, of a cross section of a tensile bar, formed from a AZ91D alloy after injection molding at an alloy overheated above the liquidus and followed by cooling back to a sub-liquidus range with 1% solid fraction, showing the representative morphology of rosette shaped solids.
Figure 10E:
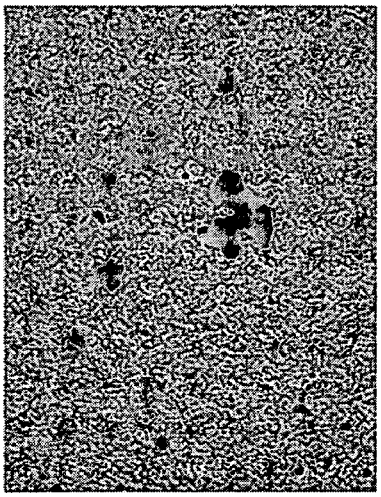
FIG. 10*e* is a microscopic image, 100 μm across, of a cross section of a tensile bar, formed from a AZ91D alloy after injection molding at an alloy overheated above the liquidus and followed by cooling back to a sub-liquidus range with 2% solid fraction, showing the representative morphology of a mixture of rosette and globular shaped solids.
Figure 10F:
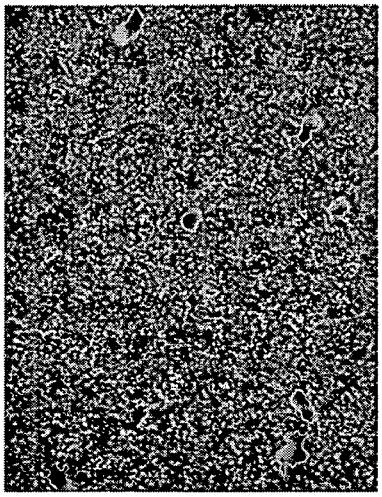
FIG. 10*f* is a microscopic image, 100 μm across, of a cross section of a tensile bar, formed from a AM60B alloy after injection molding at an alloy overheated above the liquidus and followed by cooling back to a sub-liquidus range with 3% solid fraction, showing the representative morphology of near globular shaped solids.
Figure 11A:
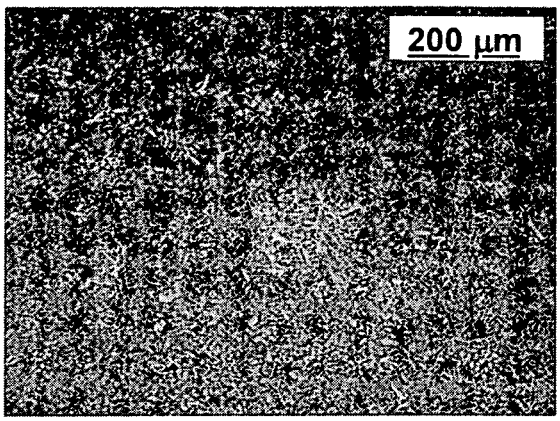
FIG. 11*a* is a microscopic image, 200 μm across, of a cross section of a tensile bar, formed from a AZ91D alloy after die casting from a superheated state, showing a general view of the resulting alloy microstructure.
Figure 11B:
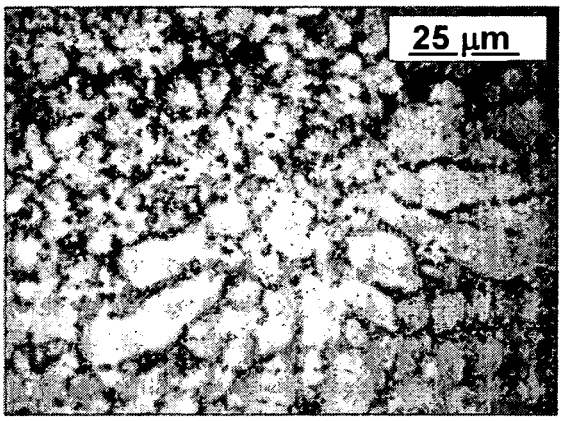
FIG. 11*b* is a microscopic image, 25 μm across, of the cross section of FIG. 11*a* showing a general view of the resulting alloy microstructure including coarse pre-eutectic dendrites within the matrix.
Figure 11C:
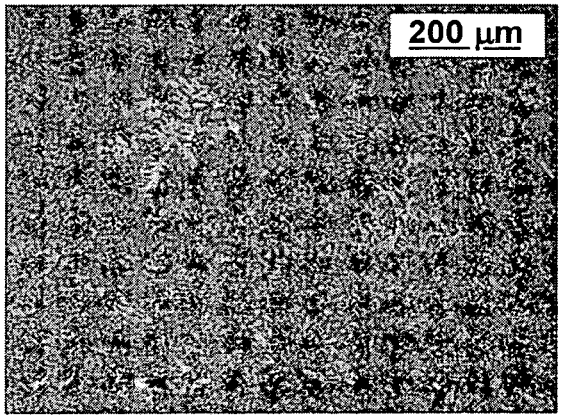
FIG. 11*c* is a microscopic image, 200 μm across, of a cross section of a tensile bar, formed from a AM60B alloy after die casting from a superheated state, showing a general view of the resulting alloy microstructure.
Figure 11D:
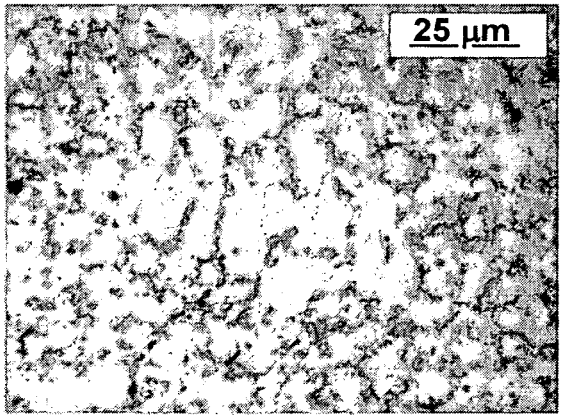
FIG. 11*d* is a microscopic image, 25 μm across, of a cross section of a tensile bar, of the cross section of FIG. 11*c* showing a general view of the resulting alloy microstructure including coarse pre-eutectic dendrites.

In addition to the matrix, a negligible fraction of the primary solid phase was present (FIGS. 10*a-e*). For very low solid contents the microscope magnifications used here may be too high to portray the representative (homogeneous) image and cannot be used directly to measure the solid content based on the stereological principles. The solid's morphology depended on the thermal profile of the barrel; however, differences were less distinct than observed previously for high solid fractions. When the alloys were preheated to a sub-liquidus temperature they had a form of rough spheroids (FIGS. 10*b,c*). The characteristic feature of the unmelted phase observed during thixomolding, i.e. the entrapped liquid, was absent here. When the alloy was overheated above the liquidus and followed by cooling back to a sub-liquidus range, the precipitated solid might have a form of degenerated rosettes (FIG. 10*d*). The role of shear in affecting the rosettes' shape is not clear here and they were sometimes observed coexisting with spheroids (FIG. 10*e*). The change in the solid's morphology and content within the range from 0 to approximately 5% was not accompanied by evident differences of the matrix (FIGS. 10*a-e*). Moreover, it was difficult to distinguish a morphological difference of the matrix and solid between the Mg—9Al—1Zn and Mg—6Al grades.

The microstructures produced from a superheated liquid by die-casting are shown in FIG. 11. For both alloys, they were inhomogeneous and contained dendrite type precipitates, formed prior to the solidification in the mold, seen as bright contrast in FIG. 11*a*. Some of precipitates were large with a size of 300-400 μm. No notable morphological differences between AM60B and AZ91D alloys were observed (FIGS. 11*b,c*). It is known that the AZ91D contains more $Mg_{17}Al_{12}$ phase but this difference was not obviously seen from optical microscopy images. The only difference appeared to be more discontinuous precipitates of $Mg_{17}Al_{12}$ in the AM60B grade.

Crystallogaphic Orientation

Figure 12A:
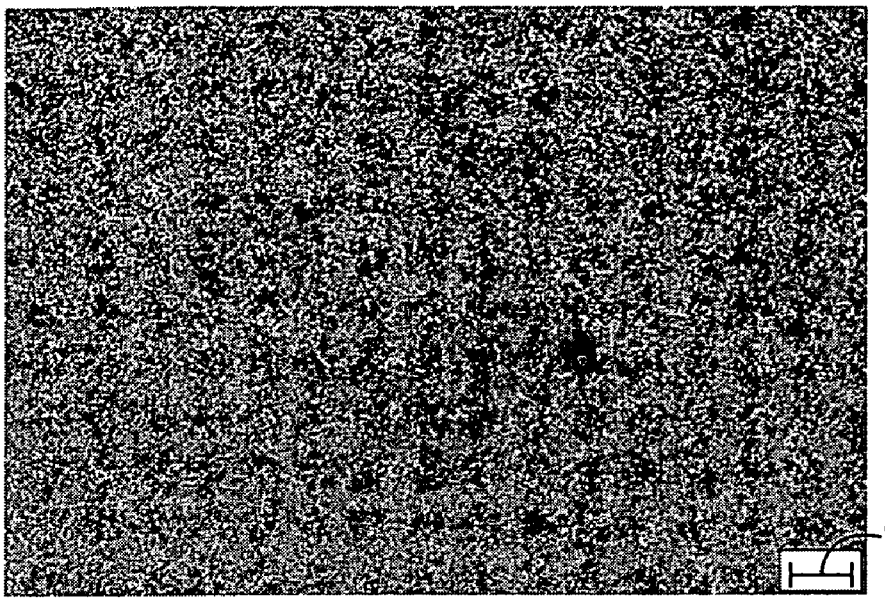
FIG. 12*a* is a microscopic image, 100 μm across, of an etching done on a cross section of a tensile bar, formed from a AZ91D alloy after injection molding with an alloy at a near liquidus temperature, revealing the differences in crystallographic orientation of structural components.

An etching technique was used as a method for the qualitative assessment of differences in crystallographic orientation between microstructural constituents. The color distribution within the microstructure, obtained by near liquidus molding, revealed that there is no dominant preferred orientation (FIG. 12*a*). No clustering was present and each small grain/cell was differently oriented.

The alloys die cast from the superheated liquid range showed large dendrites, suggesting that all features within a dendrite had the same or very similar crystallographic orientation. Some of them had the morphology of primary dendrites, formed prior to injection into a mold cavity. The etching showed that many features portrayed on conventional micrographs as individual grains, were in fact a part of the large multi-grain conglomerates (e.g. FIGS. 11*b,d*).

Phase Composition

Figure 13A:
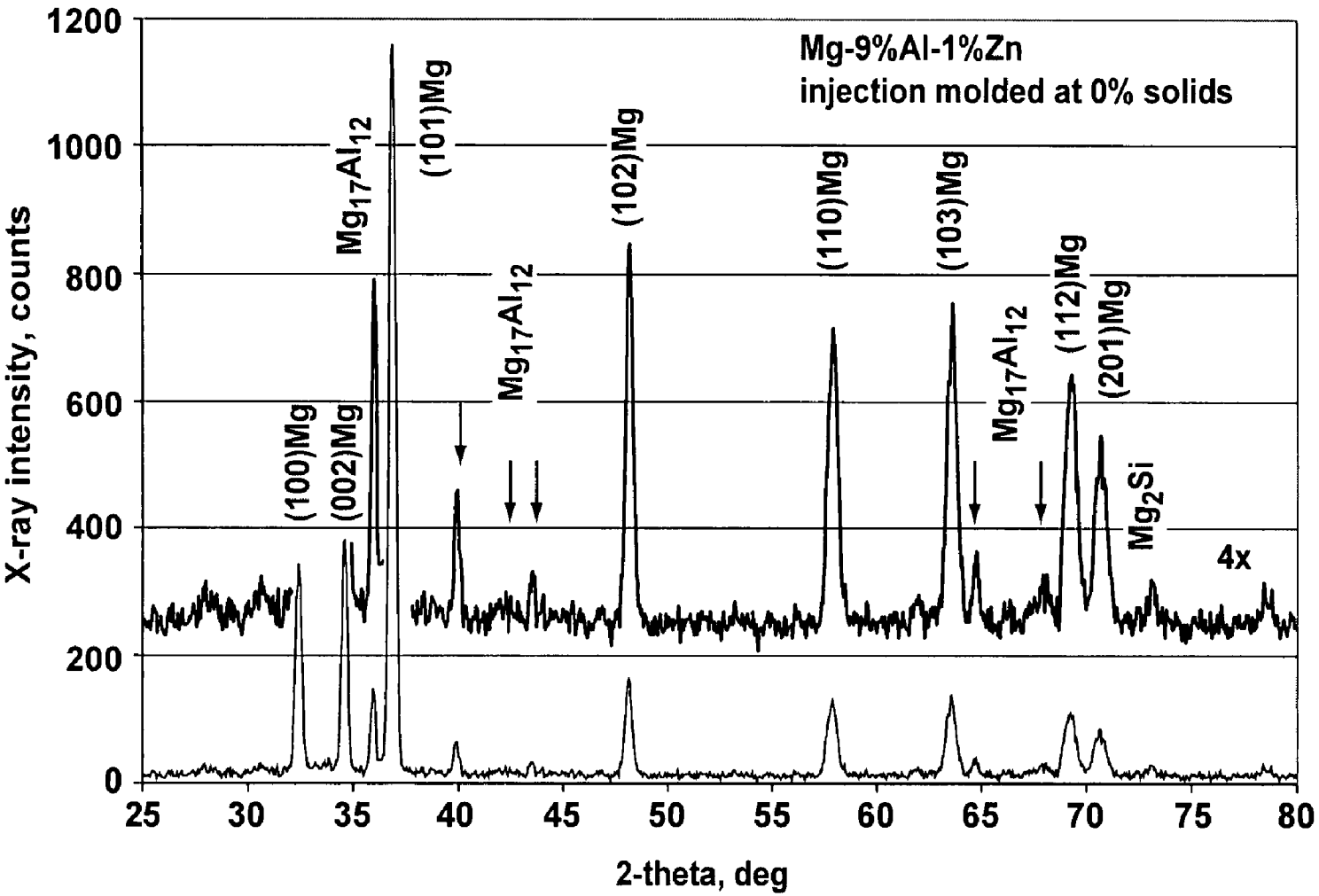
FIG. 13*a* is an X-ray diffraction pattern for an AZ91D alloy injection molded at 0% solid.
Figure 13B:
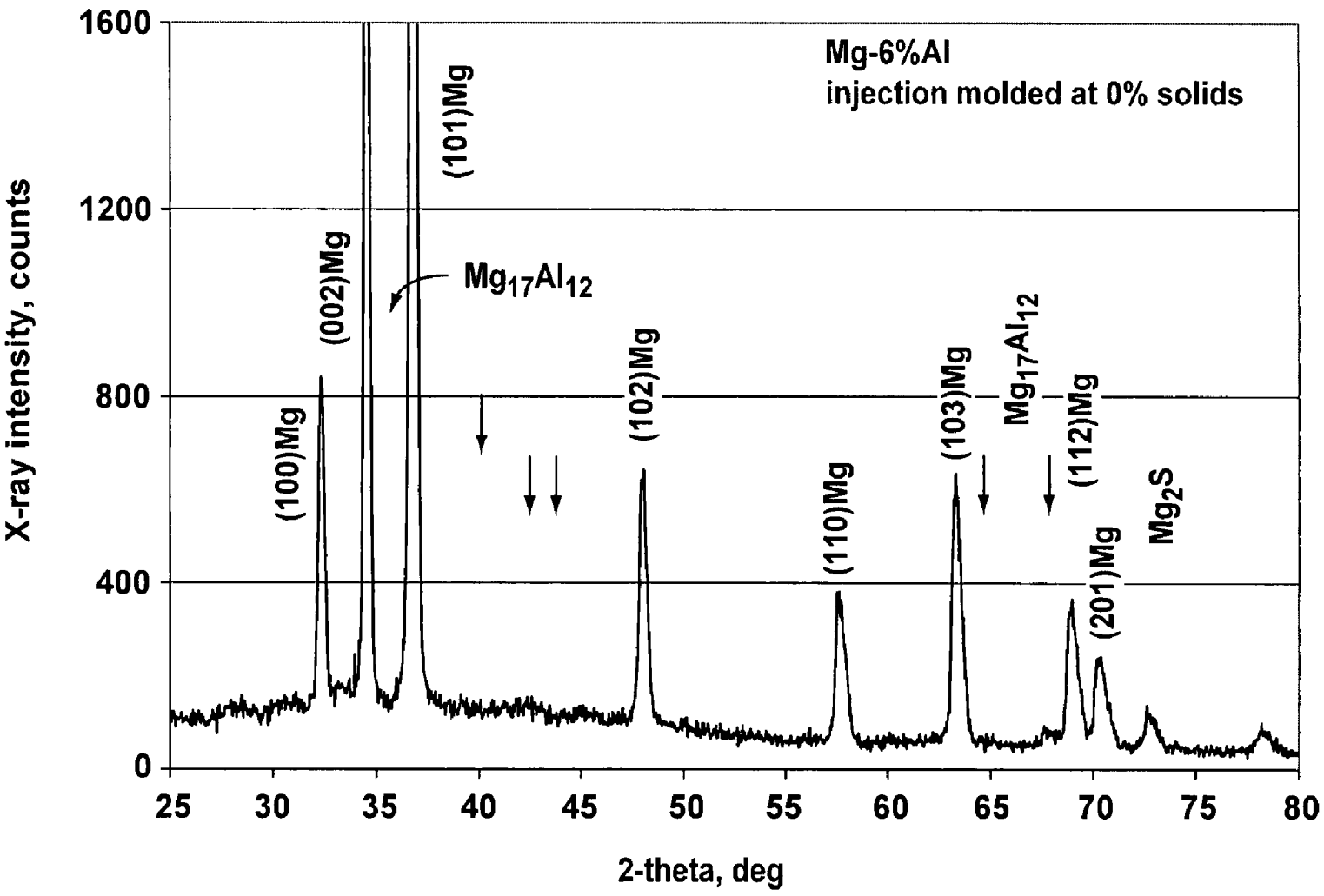
FIG. 13*b* is an X-ray diffraction pattern for an AM60B alloy injection molded at 0% solid.
Figure 13C:
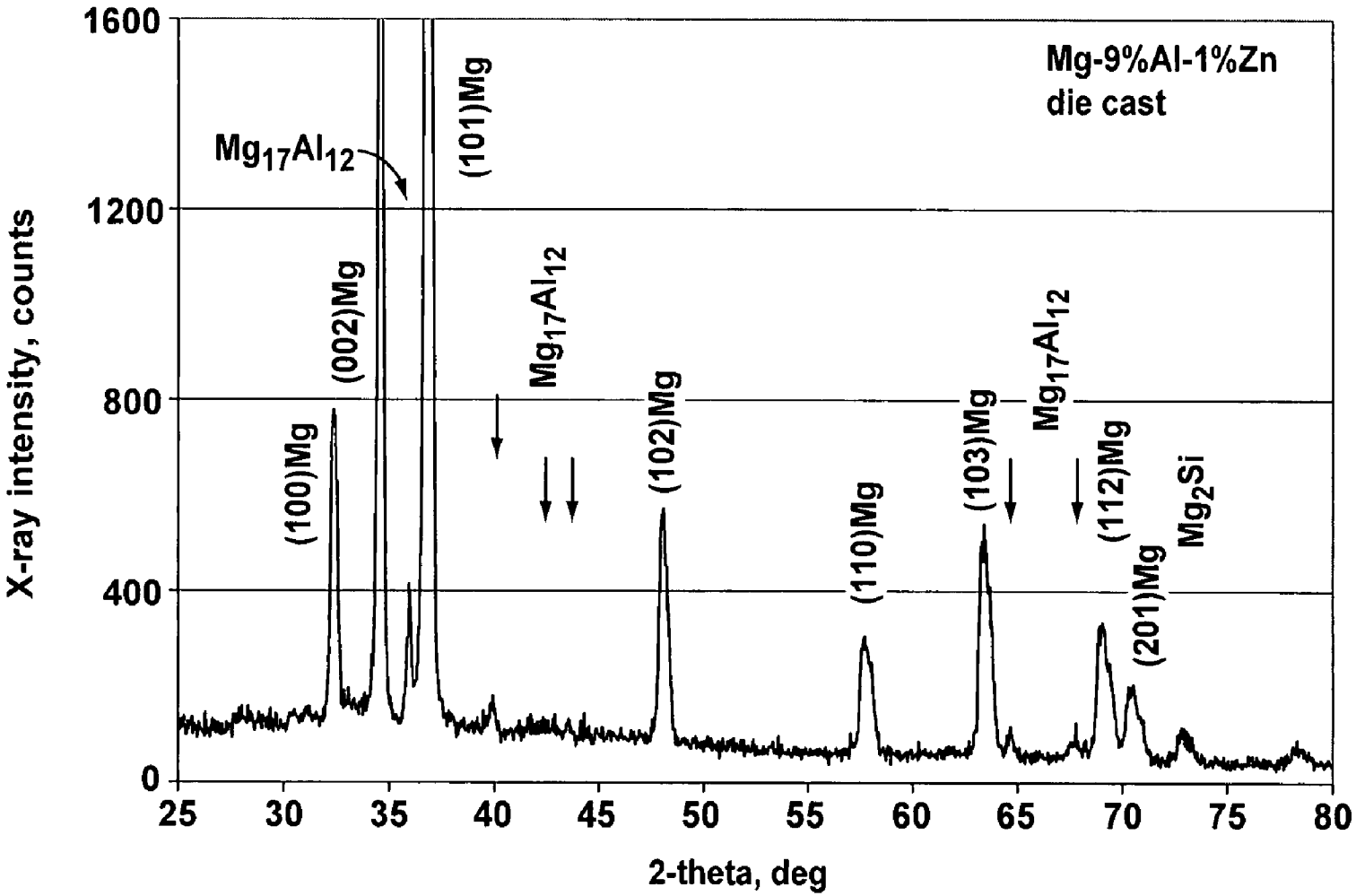
FIG. 13*c* is an X-ray diffraction pattern for an AZ91D alloy die cast starting from superheated liquid.

The X-ray diffraction provided information about the crystallography of phases, their contents and an estimation of the preferred orientation. The AZ91D alloy, molded from the near liquidus range, contained the α—Mg and intermetallic phase of $Mg_{17}Al_{12}$ (FIG. 13*a*). A comparison of peak intensities on the diffraction pattern and JCPDS standard suggests that both phases were randomly oriented. At least six peaks of $Mg_{17}Al_{12}$ were detectable and estimation indicates a volume fraction of about 9%. The AM60B alloy, molded from its liquidus range, exhibited a different X-ray diffraction pattern with virtually only an α—Mg phase (FIG. 13*b*). The anticipated locations of $Mg_{17}A_{12}$ peaks are indicated by arrows in FIG. 10*b* where their intensities are at a level of the background noise. The volume contribution of the $Mg_{17}Al_{12}$ phase, estimated from a computer analysis of the diffraction pattern, was as low as 1%. The diffraction pattern of the AZ91D alloy, die cast from a melt, superheated to 670° C., is shown in FIG. 13*c*. It exhibits visually detectable lower intensities of $Mg_{17}Al_{12}$ peaks than that after near-liquidus molding, shown above in FIG. 13*a*. The estimated content of the $Mg_{17}Al_{12}$ phase was around 7%.

De-Cohesion Characteristics

Figure 14A:
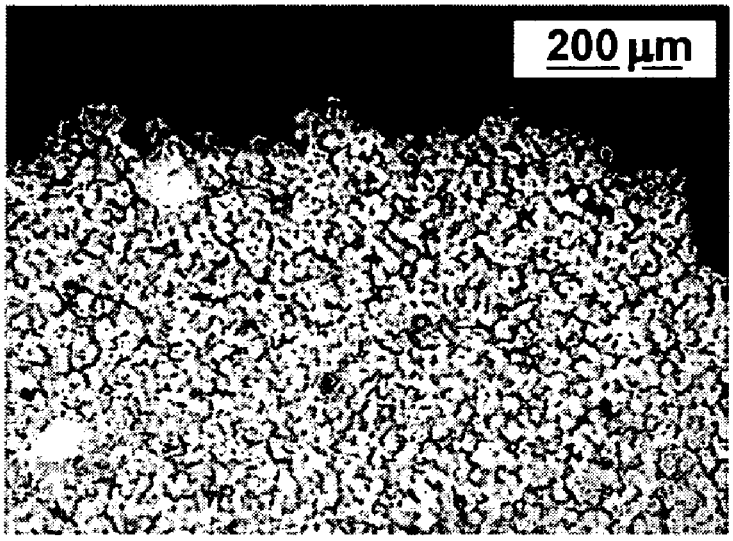
FIG. 14*a* is a microscopic image, 200 μm across, of the de-cohesion surfaces of a tensile bar formed from a AZ91D alloy injection molded from the near-liquidus range.

There was a significant difference in the morphology of the de-cohesion surface between the near-liquidus molded and the superheated liquid die cast structures. The typical cross-sectional view of an AZ91D tensile bar after near-liquidus molding is shown in FIG. 14*a*. The crack penetrated along the $Mg_{17}Al_{12}$ intermetallic phase, in particular, along the interface between the α—Mg and the intermetallics. There was no noticeable coarsening of pores in the crack vicinity and no transcrystalline cracking of the primary solid was observed. Instead, the crack penetrated along the interface between the primary solid and surrounding matrix. There were numerous particles of Mn—Al—Fe and $Mg_2Si$, undissolved during alloy melting. Since they were not observed on the de-cohesion surface, their contribution to cracking is not clear.

Figure 14B:
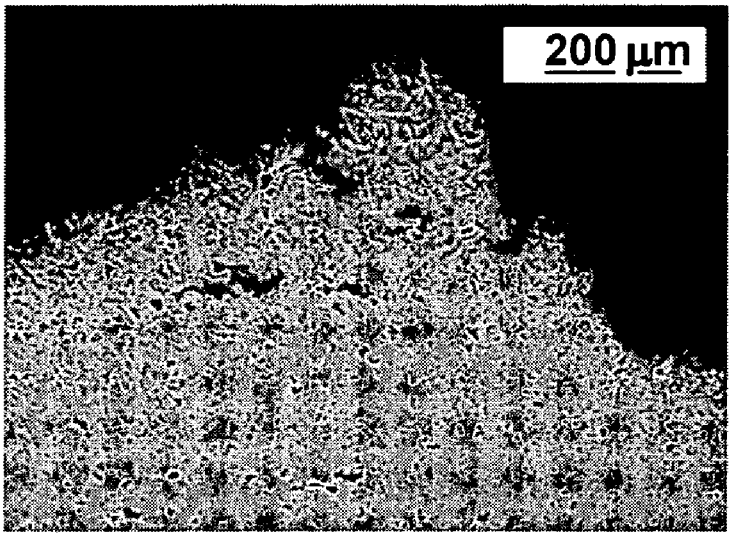
FIG. 14*b* is a microscopic image, 200 μm across, of the de-cohesion surfaces of a tensile bar formed from a AZ91D alloy die cast from an overheated liquid.
Figure 14C:
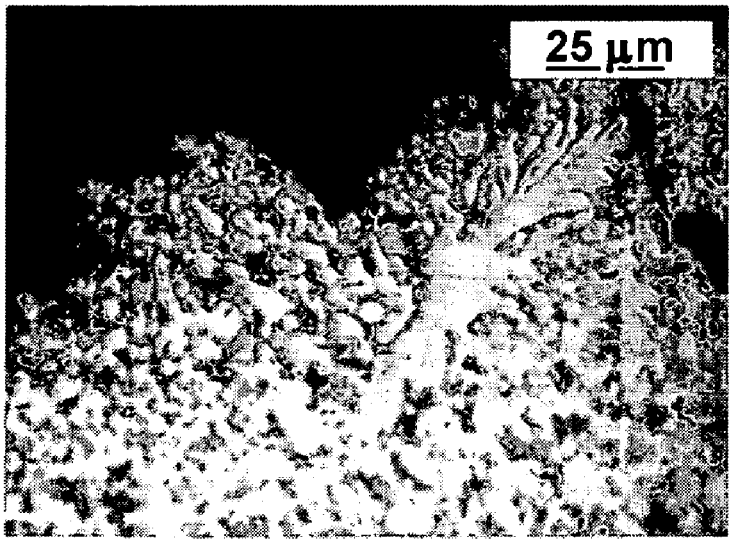
FIG. 14*c* is a microscopic image, 25 μm across, showing the crack propagation path between the coarse dendrite and surrounding matrix in the tensile bar of FIG. 14*b;*

The dendritic morphologies present within the alloy, processed from the superheated liquid, exerted a profound influence on the fracture mechanism (FIG. 14*b*). The regions which separated the coarse dendrites and had different crystallographic orientation than the remaining matrix were the weakest paths, susceptible to cracking (FIG. 14*c*). Outside such coarse dendrites, the α—Mg—$Mg_{17}Al_{12}$ intermetallic interface was the typical propagation path. Under stress, the shrinkage pores were enlarged significantly and this was particularly obvious for pores residing in the direct vicinity of the de-cohesion surface.

CONCLUSION

Figure 12B:
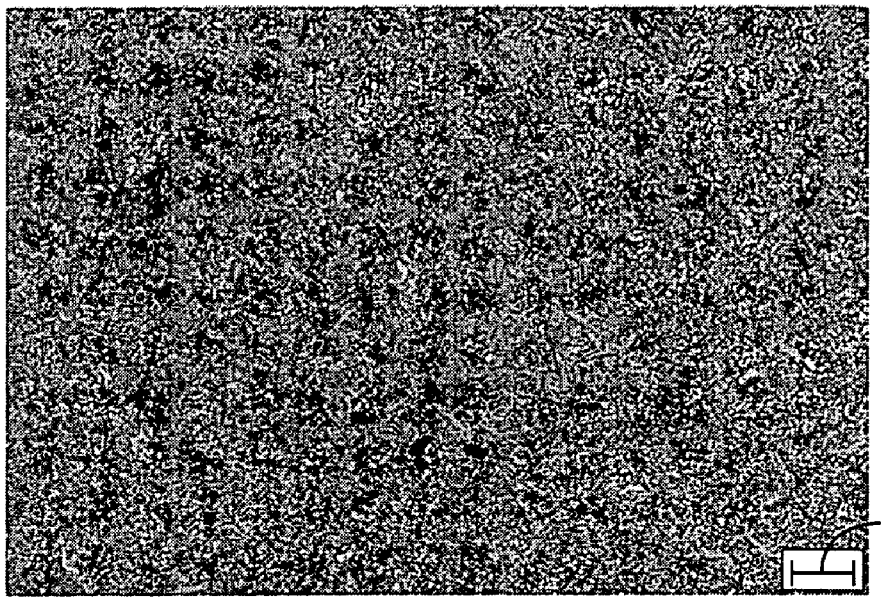
FIG. 12*b* is a microscopic image, 100 μm across, of an etching done on a cross section of a tensile bar, formed from a AZ91D alloy after die casting from a superheated state, revealing the differences in crystallographic orientation of structural components.

The experiments conducted show that the injection molding of magnesium alloys, preheated to tight temperatures around the liquidus value, diminishes some disadvantages typical for the casting of superheated melts. Negligible porosity (FIGS. 9, 10 and 12), is most likely attributed to the specific solidification mechanism and resultant fine, uniform structure, as discussed below. Further, the step of densification after mold filing is also believed to reduce the internal porosity of the molded article.

The operating temperatures at around 70-100° C. lower than the die cast alloys also brings advantages expressed by energy savings, reduced deterioration of machine/mold components and reduced alloy losses by evaporation and oxidation. Since injection molding relies on the barrel sealing concept using a thermal plug, it does not allow for substantial overheating of the molten alloy. Therefore, as a processing which utilizes a superheated melt, die-casting was selected here. Both the hot and cold chamber die castings start from a superheated liquid and suffer from the disadvantage that it is difficult to produce fully sound components. A superheating is required to compensate for the heat loss during transfer to and delay time in the hot sleeve. There are a number of key differences between die-casting and injection molding at all stages of processing and the alloy's temperature is only one of them. This should be kept in mind while comparing results obtained by both techniques.

In addition to the component's integrity, the processing temperature exerts an effect on the alloy microstructure (FIGS. 9 and 10). The non-equilibrium solidification of magnesium alloys starts with a nucleation of the primary α—Mg phase. Subsequent dendritic growth occurs and the remaining liquid in the interdendritic regions finally solidifies as a divorced, or partially divorced, eutectic. It is known that lowering the pouring temperature promotes the formation of equi-axed solidification structures. When superheating is sufficiently low, the whole melt is undercooled and copious heterogeneous nucleation takes place throughout the melt. This leads to complete elimination of the columnar zone in the casting and to the formation of fine equi-axed grains in the entire volume. When rheocasting was first discovered, it was believed that one had to break up the dendritic structure during the freezing process either by mechanical stirring or via other forms of agitation. Then, the fragments of dendrites within the melt volume were believed to act as nuclei for new grains to transform into spheroids. This mechanism was not supported by direct observations of the solidification of transparent liquids with metal-like crystallization characteristics and numerical modeling, which state that globular crystals form through direct nucleation from a liquid instead of from fragments of broken dendrites. Essentially, the globular structure develops by controlling the nucleation and growth processes at the early stages of freezing.

Another factor, potentially affecting the solidification process of a molded alloy, is the agitation exerted by the reciprocating screw during conveyance along the barrel and high injection speed during mold filling. In fact, it is difficult to separate those two contributions. Turbulence introduced by high intensity shear affects destabilization of diffusion boundary layer and also prevents solute build up ahead of the solid-liquid interface and thus suppresses dendritic growth due to compositional undercooling. As seen in FIG. 10, solidification does not lead either to the growth of existing, or the formation of new solid globules. This aspect may also be affected by shear. It is argued that a compact spherical morphology of the primary particles and the absence of a prominent diffusion boundary layer around them restrict the growth of these particles due to less available kinks at the solid-liquid interface. For this reason, solidification by a means of fresh nucleation within the melt volume is kinetically favoured over the growth of existing particles. Thus a shear rate promotes intense turbulence in the semi-solid slurry and establishes a uniform temperature distribution throughout the melt and this condition is ideal for nucleation throughout the melt.

For semi-solid processing, the room temperature microstructure allows us to reproduce a thermal history of the alloy. While exploring the near-liquidus temperatures, the features which provide the link to the processing parameters, are less distinct. For sub-liquidus molding, the alloy's temperature may be estimated based on measurements of the unmelted solid fraction. A lack of entrapped liquid does not allow distinguishing between rheo- and thixo-routes, meaning that it is not an indication whether the liquidus temperature was achieved from the solid or liquid direction (FIG. 10). When the liquidus temperature is exceeded and the last granules of the primary solid dissolve, the estimation becomes even more ambiguous. For cooling of the completely molten and then partially re-solidified alloy, the solid morphology is controlled by the shear imposed. Evidence of overheating would be the presence of rosettes or dendrites precipitated when the melt temperature was subsequently reduced below the liquidus prior to injection. A generally low sphericity of globules, frequently co-existing in mixtures with rosettes (FIG. 10*e*), suggests the rather low effectiveness of the shear at such negligible solid fractions, and therefore an increased error in assessment of the processing conditions.

While considering the beneficial changes of mechanical properties after semi-solid processing, two factors are frequently mixed: (i) an improvement caused by a reduction in porosity and (ii) a change due to a modification of the microstructure. It is clear that the high integrity structures, generated after near-liquidus molding, take advantage of the first factor. Experiments conducted here allow assessing the influence of the structure-related factor. A variation in tensile properties of both molded alloys, shown in FIGS. 6 and 7, is of the same nature as described previously for semi-solid-state regime molding. The reduction in strength for the individual alloys AZ91D and AM60B is associated with an increased volume of coarse globules of the primary solid. A reduction in strength with an increasing content of α—Mg globules, seen in FIG. 6, was also reported for rheocasting, and thixocasting. For rheocasting, an empirical formula was developed to link the tensile strength $\sigma_{UTS}$ with the solid fraction $f_s$:

$$\sigma_{UTS}(\text{MPa})=124(1-f_s)+[72+547d^{-1/2}]f_s \quad (2)$$

where d represents grain size. The maximum strength of 124 MPa in formula (2) for $f_s$ equal 0 is significantly lower than values reported in FIG. 6. A presence of primary solids results in an enrichment of the remaining liquid in Al, creating more $Mg_{17}Al_{12}$ precipitates, affecting matrix ductility.

When comparing the AZ91D and AM60B grades, the major difference is the higher elongation of the latter. It is generally accepted with the quantitative evidence published that the first alloying approach for better toughness is to reduce the volume fraction of the $Mg_{17}Al_{12}$ intermetallic phase: the content of $Mg_{17}Al_{12}$ was in the range of 2-7% for AM60 grade and from 5 to 16% for AZ91D. Thus, the higher elongation of AM60B in FIGS. 6 and 7 is associated with a significantly lower fraction of the intermetallic phase, primarily caused by the lower content of Al. The rough estimation based on X-ray measurements of this research provides $Mg_{17}Al_{12}$ fractions between 1% for AM60B and 9% for AZ91D. It appears at the same time that die cast alloys showed a slightly lower content of the $Mg_{17}Al_{12}$ phase, around 7% for AZ91D grade (FIG. 13). Since the strength of AM60 and AZ91 grades is very similar (FIG. 6), this finding would suggest that for optimum properties a further increase in elongation the AZ911 alloy, molded from near liquidus ranges, would require a reduced content of Al.

Figure 15A:
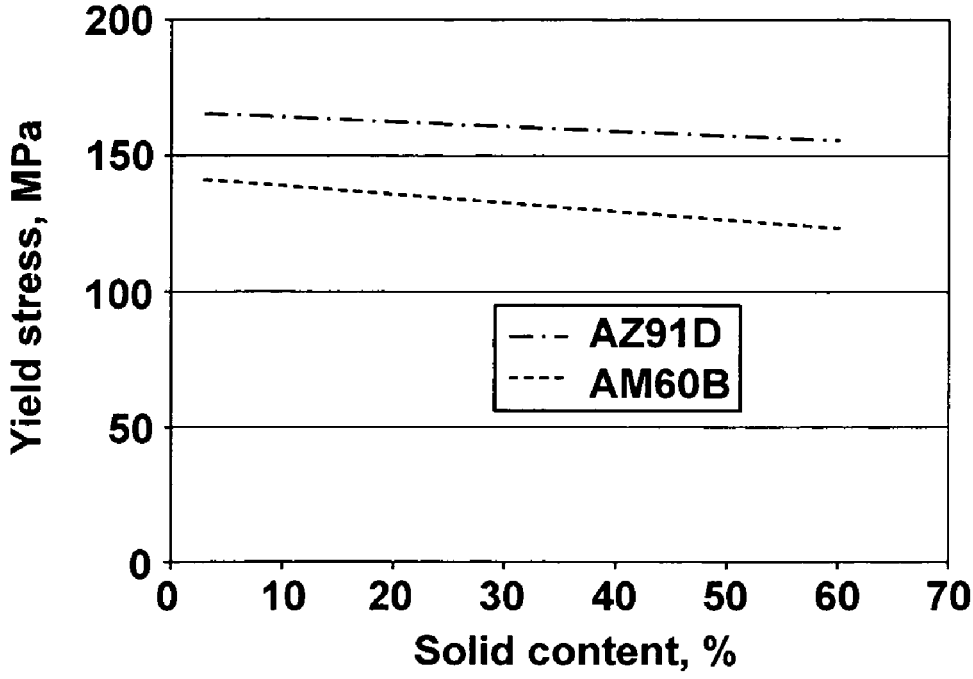
FIG. 15*a* is a plot of yield stress as a function of solid content for a tensile bars formed from AZ91D and AM60B alloys that are injection molded from the near-liquidus range.
Figure 15B:
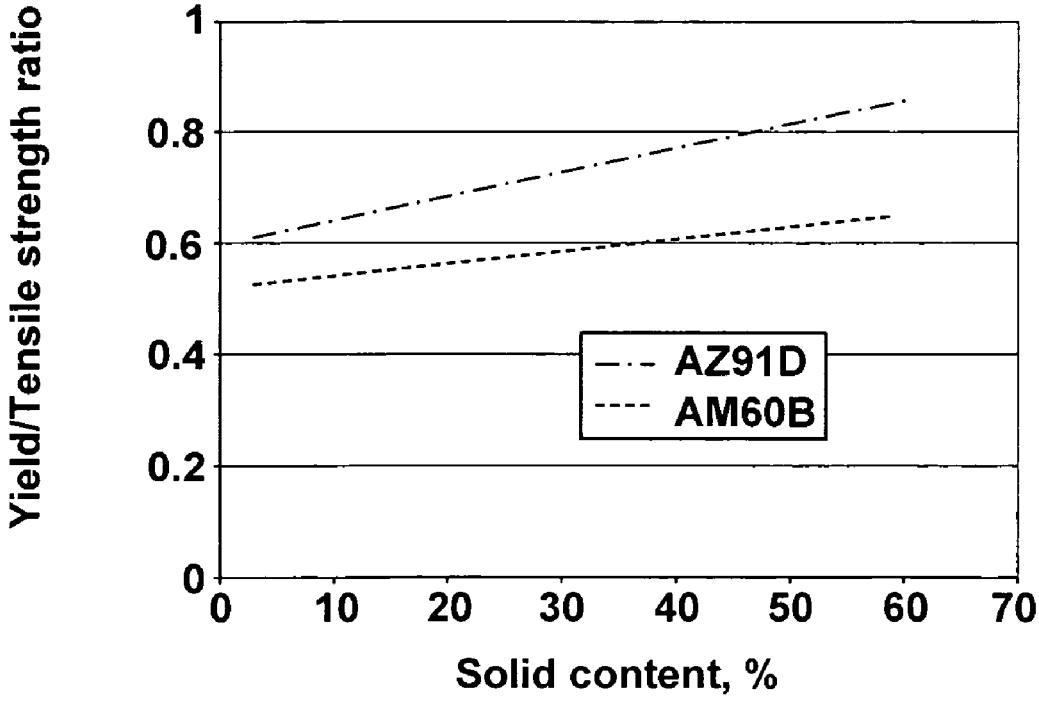
FIG. 15*b* is a plot of yield stress tensile ratio as a function of solid content for a tensile bars formed from AZ91D and AM60B alloys that are injection molded from the near-liquidus range.

It is generally accepted that semi-solid processing provides properties which are superior over those obtained after conventional casting. While the foregoing can be shown for Al alloys, for Mg—Al and Mg—Al—Zn alloys an increased solid content has shown a reduction in both strength and ductility. The metallurgical characteristics gathered here and in previous research as shown in FIGS. 15*a* and 15*b* suggest that Mg—Al and Mg—Al—Zn alloys with their solidification structures are not best suited for semi-solid processing with substantial content of the unmelted fraction. Therefore, for Mg—Al and Mg—Al—Zn alloys, the near-liquidus molding is a technology of choice to achieve the high integrity structures with the maximum combination of strength and ductility.

It is also expected that similar results will be obtained with near-liquidus molding of other alloys suitable for injection molding, as will be appreciated by those skilled in the art.

The injection molding system allows implementing a concept of near liquidus processing which requires a tight control of the alloy's temperature such that the alloy is maintained at a near-liquidus temperature, as close to the molding cavity as possible. The injection mold 24 is preferably configured to include at least one temperature controlled melt conduit such as a hot sprue or a hot runner to convey the melt to the gate during injection and maintain it at processing temperatures between injection cycles. A suitable system is described in Applicant's co-pending U.S. patent Office application Ser. No. 10/846,516, the disclosure of which is herein incorporated by reference. By using such a system, the flow distance between the molten alloy with a controlled temperature and the mold gates is reduced, thus minimizing a drop in temperature. Preventing heat losses has a particular meaning for magnesium alloys, known for their low thermal capacity and tendency to quick solidification, which disrupts the complete filling of the mold.

The molding of Mg—9Al—1Zn and Mg—6Al alloys, after preheating to a narrow temperature range around the liquidus level, leads to the formation of high-integrity structures. Shrinkage porosity, unavoidably present after conventional casting, which utilizes superheated melts, is minimized to negligible level.

The matrix of near-liquidus molded Mg—9Al—1Zn and Mg—6Al alloys is macroscopically homogeneous and consists of fine equi-axed structures of α—Mg with a typical size of 20 mm and no coarse directional dendrites which would result from pre-eutectic solidification. The α—Mg grains are surrounded by mostly discontinuous precipitates of the Mg17Al12 intermetallic phase with a slightly higher content than after casting from superheated melts. The primary solid is either completely absent or present in negligible amounts, not exceeding 5% of volume fraction. The solid particles do not contain any entrapped liquid and represent a morphology from spheroids to degenerated rosettes, depending on the thermal profile along the alloy's flow path within the system.

The near-liquidus molded Mg—9Al—1Zn and Mg—6Al alloys exhibit a superior combination of strength and elongation than their counterparts produced from the superheated liquid and by the semi-solid route. The tensile properties benefit from high structural integrity and fine microstructure.

A metal-matrix composite is a combination of a metallic component with a reinforcement component. The reinforcement component is usually non-metallic and is commonly a ceramic or other material such as (for example): continuous fibers such as boron, silicon carbide, graphite or alumina; wires including tungsten, beryllium, titanium and molybdenum; and/or discontinuous materials such as fibers, whiskers and particulates. The metal component provides a compliant support for the reinforcement component. The reinforcement component is embedded into the metal component. The reinforcement component does not always serve a purely structural task (reinforcing the metal component), but is also used to change physical properties such as wear resistance, friction coefficient, thermal conductivity, stiffness, strength, heat resistance, etc. The reinforcement component can be either continuous or discontinuous. A discontinuous metal-matrix composite is isotropic and can be worked with standard metalworking techniques. A continuous reinforcement component uses monofilament wires or fibers such as carbon fiber or silicon carbide. Because the fibers are embedded into the metal component in a certain direction, the result is an anisotropic structure in which the alignment of the material affects its strength. One of the first metal-matrix composites used boron filament as the reinforcement component. The discontinuous reinforcement component uses "whiskers", short fibers, or particles.

The metal-matrix composite is produced by means of processes other than conventional metal alloying. The metal-matrix composite is often produced by combining two pre-existing constituents (such as, a metal and a ceramic fiber). Processes commonly used include powder metallurgy, diffusion bonding, liquid phase sintering, squeeze-infiltration and stir-casting.

Alternatively, typical high-reactivity of metals at processing temperatures can be exploited to form the reinforcement component and/or the metal-matrix composite in situ (that is, by chemical reaction within a precursor of the metal-matrix composite).

A metal-matrix composite (including a metallic component and a reinforcement component embedded in the metallic component) was molded at a near-liquidus temperature of the metallic component by a molding process of an injection molding machine. The injection molding machine was a Husky™ Thixo 5 injection-style molding machine. Generally the method involved maintaining or controlling a temperature of a slurry of the metal-matrix-composite (which was located in at least a part of the molding machine, preferably located in a head portion of the molding machine) within a temperature range near to (relative to and/or there around) the liquidus temperature of the metallic component so that the slurry of the metal matrix composite had a solid content that ranged from about 0% to about 5%. It will be appreciated that the temperature range will vary depending on the alloy used. A metal matrix composite that was made by this method included a metallic component molded by a molding machine, that was configured to control a temperature of the slurry within a temperature range near the liquidus temperature of the metallic component, and the slurry had a solid content ranging from about 0% to about 5%.

By way of example, for a slurry of a metal-matrix composite that included a metallic component having an alloy of Mg (specifically: AZ91), in which the liquidus temperature of the AZ19 alloy was about 695 degrees Celsius, the temperature of the slurry was held, in at least a part of the molding machine) within a temperature range that extended from about 695 degrees Celsius to about 693 degrees Celsius (that is: about 695 degrees Celsius minus about 2 degrees Celsius). A molded metal matrix composite having the alloy AZ19 of Mg had a solid content that ranged from about 0% to about 5%. It will be appreciated that the temperature range of other metal-matrix composites will be different, and the temperature range will depend on the type of alloy included in the metallic component of the metal-matrix composite.

In a preferred embodiment, the metallic component included a magnesium (Mg) alloy, and the reinforcement component included either finely-granulated particles of silicon carbide (SiC). In an alternative embodiment, the metallic component includes a magnesium-based alloy and/or an aluminum-based alloy and/or a zinc-based alloy and any combination and permutation thereof. The magnesium alloy was AZ91D having a low solid content.

The specimen molded by the molding machine was a tensile bar. The tensile bar is an injection-molded specimen of specified dimensions, and the specimen is used to determine tensile properties of a material included in the specimen.

The preferred method included the following steps or operations: A mold defining four molding cavities was preheated to 200 degrees Celsius (° C.). Chips of magnesium and a predetermined volume of SiC particles were introduced into a molding machine hopper that was coupled to the molding machine. The silicon carbide particles (with different sizes) were added in different rates and volumes. The nature (either thixo and/or rheo) of the metal-matrix composite was not controlled in a barrel of the molding machine. During flow within a barrel of the molding machine, SiC particles were mixed with the magnesium alloy that was heated to a semisolid state. The molding machine was arranged to accumulate a shot of the metal-matrix composite having a predetermined shot size. Preferably, the metallic component included a metallic-alloy slurry that had a "controlled" amount of solid content while processed in the barrel (it will be appreciated that this condition is not a necessary condition).

The preferred method also included the following steps or operations: A total weight of the shot was computed to be 250.3 grams (g), which included 143.7 g of sprue with runners and 35 g of overflows. The shot was accumulated in front of a non-return valve. A processing screw was accelerated forwardly to approximately 2 metres per second (m/s), and as a result the shot was injected through the sprue and the gates and then into the four mold cavities. Further mixing of the SiC particles took place during filling of the mold cavities. It is believed that the SiC particles were sufficiently homogeneously distributed within the molded tensile bar. The sprue and the gates defined passageways therein has a cross sectional area of 65 square millimeters ($mm^2$). The barrel of the molding machine that contained the screw had a diameter of 70 mm and a length of approximately of 2 m (metres). A thermal profile of the barrel was controlled by electric-resistance heaters placed onto the barrel, and the heaters were grouped into heating zones. The thermal profile of the barrel was arranged so that the molded metal matrix composite included the metallic component that had a fraction of an un-melted phase from about 0% to about 5%.

In an alternative, the reinforcement component was selected to be chemically reactive, at least in part, with the metallic component. In another alternative, the reinforcement component was selected to be chemically non-reactive with the metallic component.

In an alternative, the reinforcement component included a metallic alloy. In another alternative, the reinforcement component included a non-metallic component. In yet another alternative, the reinforcement component included a powder. In yet another alternative, the reinforcement component included boron nitride (BN).

The following is a discussion of the metallographical assessment of a metal-matrix composite molded at near-liquidus temperature. A technical result of the embodiment is that the SiC particles are substantially uniformly distributed within the metal-matrix composite.

Figure 16:
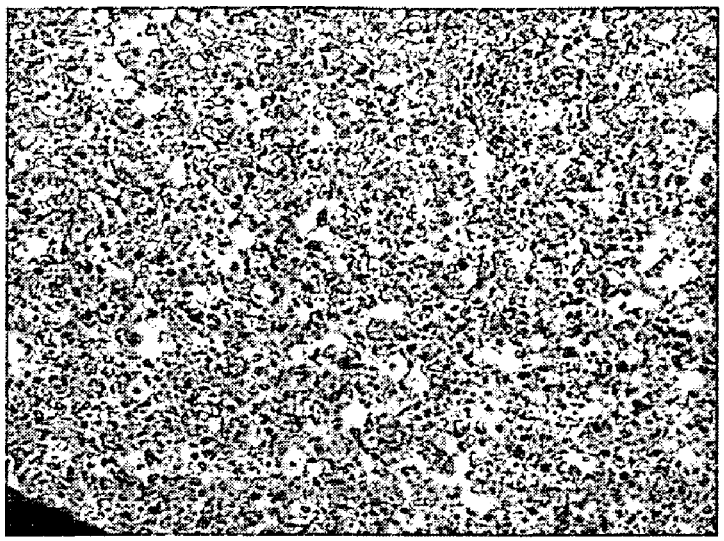
FIG. 16 is a representation of a microstructure of a sample No. 1 of a metal-matrix composite molded at a near-liquidus temperature.

FIG. 16 is a representation of a microstructure of a sample No. 1 of a metal-matrix composite molded at a near-liquidus temperature. FIG. 16 is scaled at 10 mm (millimeters)=200 μm (micrometers). In the sample No. 1, the SiC included finely graded particles.

Figure 17:
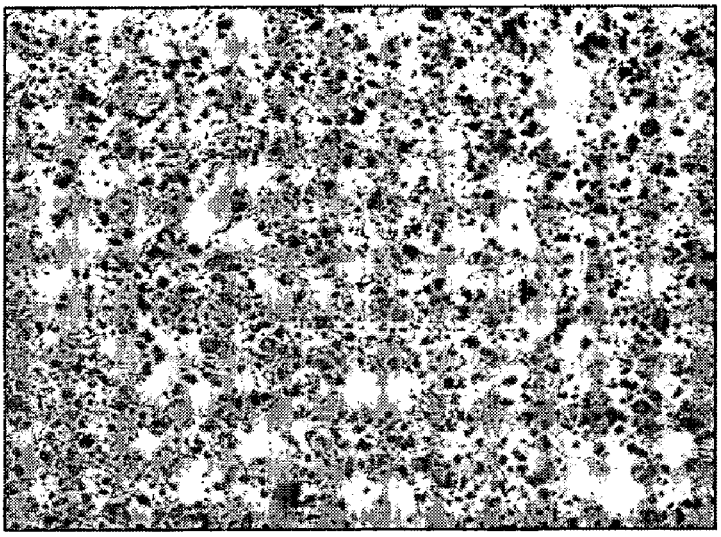
FIG. 17 is a representation of the microstructure of FIG. 16 at a higher magnification.

FIG. 17 is a representation of the microstructure of FIG. 16 at a higher magnification. FIG. 17 is scaled at 10 mm=100 μm.

Figure 18:
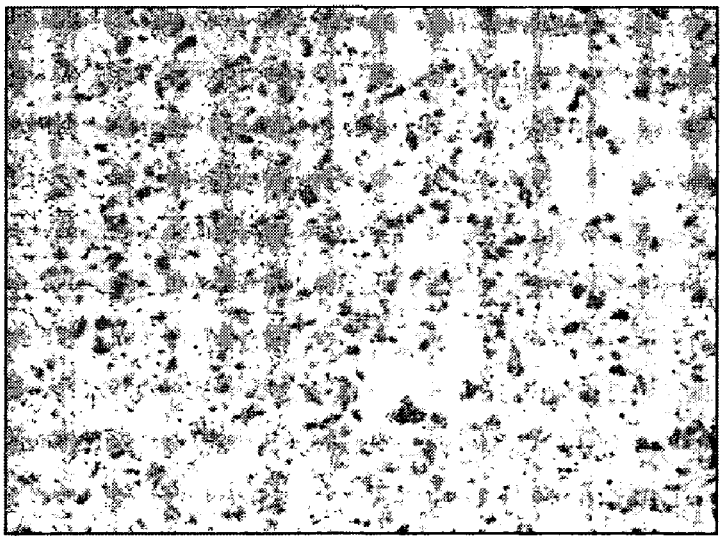
FIG. 18 is a representation of the microstructure of FIG. 16 at a higher magnification.

FIG. 18 is a representation of the microstructure of FIG. 16 at a higher magnification. FIG. 18 is scaled at 10 mm=50 μm.

Figure 19:
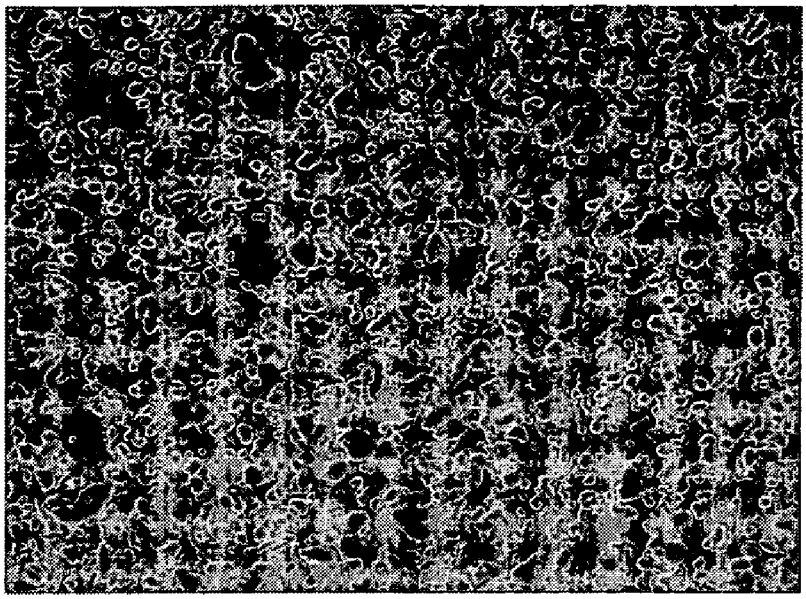
FIG. 19 is a representation of a microstructure of FIG. 16 in which details are shown at a higher magnification.

FIG. 19 is a representation of a microstructure of FIG. 16 in which details are shown at a higher magnification. FIG. 19 is scaled at 10 mm=50 μm.

Figure 20:
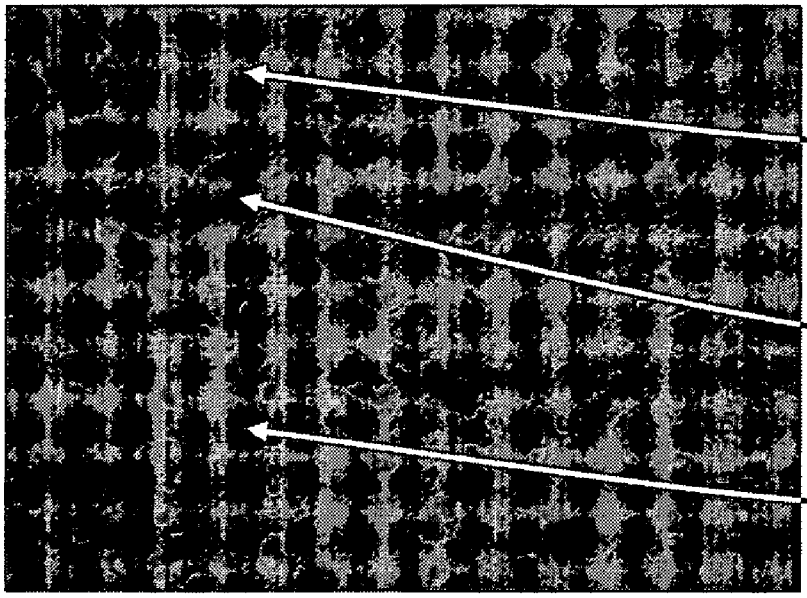
FIG. 20 is a representation of the microstructure of FIG. 16 in which details are shown at a higher magnification.

FIG. 20 is a representation of the microstructure of FIG. 16 in which details are shown at a higher magnification. FIG. 20 is scaled at 10 mm=25 μm. Item 2002 is primary solid α—Mg. Item 2004 is SiC reinforcement particles. Item 2006 is a matrix-transformed liquid fraction. The metallic component and the reinforcement component combine to form a substantially homogeneous macro-structure. A technical effect of this embodiment is that the metallic component and the reinforcement component form a substantially homogeneous micro-structure.

Figure 21:
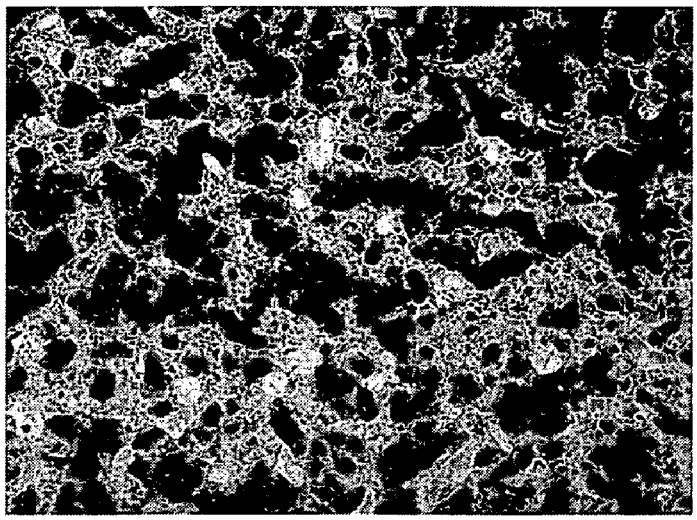
FIG. 21 is a representation of the microstructure of a sample No. 2 of a metal-matrix composite molded at a near liquidus temperature.

FIG. 21 is a representation of the microstructure of a sample No. 2 of a metal-matrix composite molded at a near liquidus temperature. FIG. 21 is scaled at 10 mm=200 μm. In the sample No. 2, the SiC included coarsely graded particles.

Figure 22:
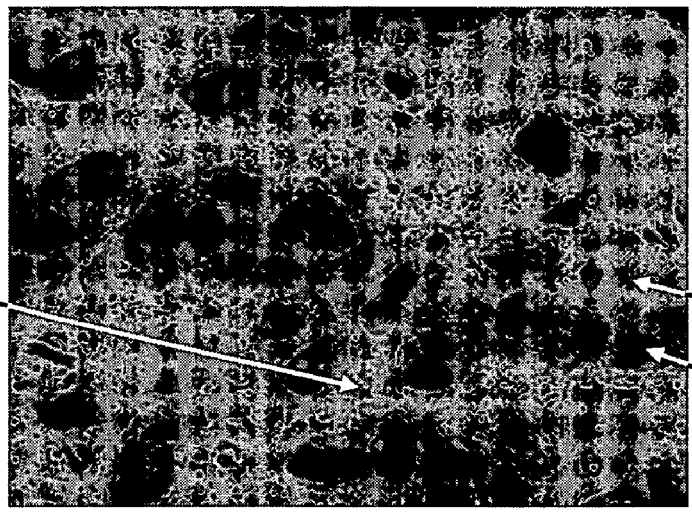
FIG. 22 is a representation of the microstructure of FIG. 21 in which details are shown at a higher magnification.

FIG. 22 is a representation of the microstructure of FIG. 21 in which details are shown at a higher magnification. FIG. 22 is scaled at 10 mm=25 μm. Item 2202 is primary solid α—Mg. Item 2204 is SiC reinforcement particles. Item 2206 is matrix-solidified liquid fraction.

Figure 23:
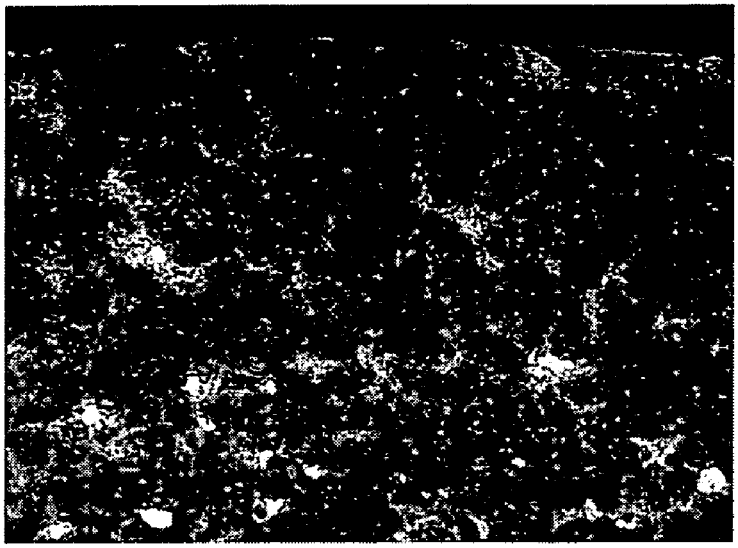
FIG. 23 is a representation of the microstructure of a sample No. 3 of a metal-matrix composite molded at a near liquidus temperature.

FIG. 23 is a representation of the microstructure of a sample No. 3 of a metal-matrix composite molded at a near liquidus temperature. FIG. 23 is scaled at 10 mm=200 μm. In the sample No. 3, the SiC includes coarsely graded particles.

Figure 24:
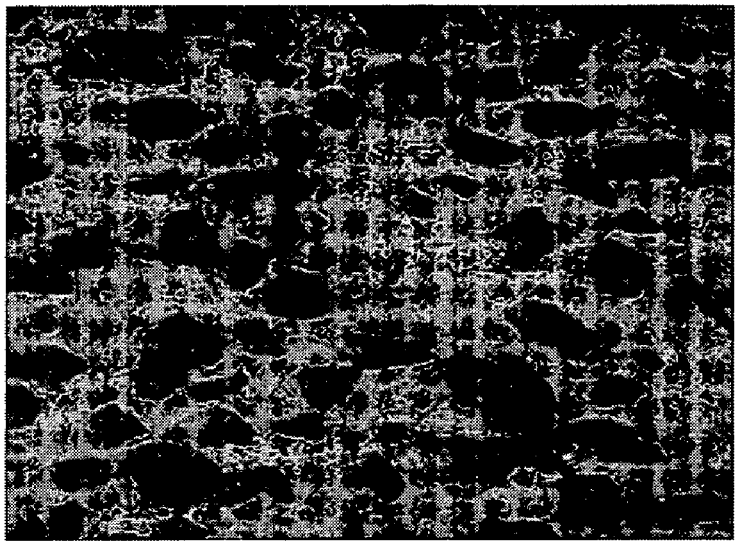
FIG. 24 is a representation of the microstructure of FIG. 23 in which details are shown at a higher magnification.

FIG. 24 is a representation of the microstructure of FIG. 23 in which details are shown at a higher magnification. FIG. 24 is scaled at 10 mm=50 μm.

Figure 25:
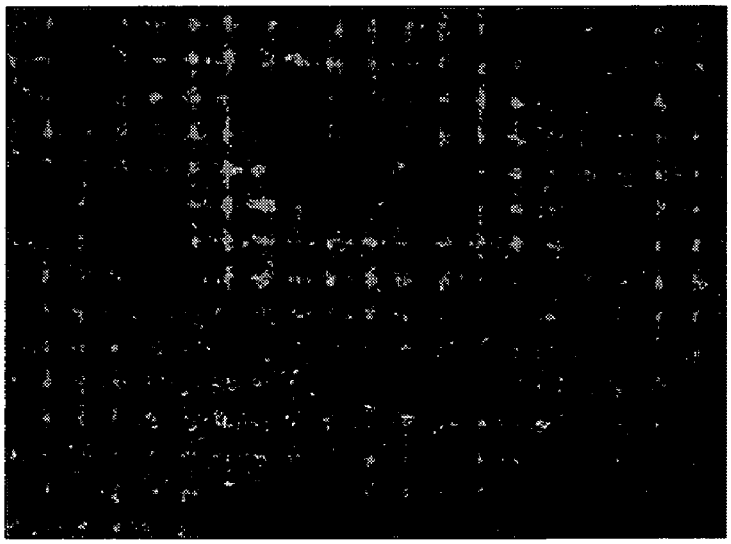
FIG. 25 is a representation of the microstructure of FIG. 23 in which details are shown at a higher magnification.

FIG. 25 is a representation of the microstructure of FIG. 23 in which details are shown at a higher magnification. FIG. 25 is scaled at 10 mm=25 μm.

Figure 26:
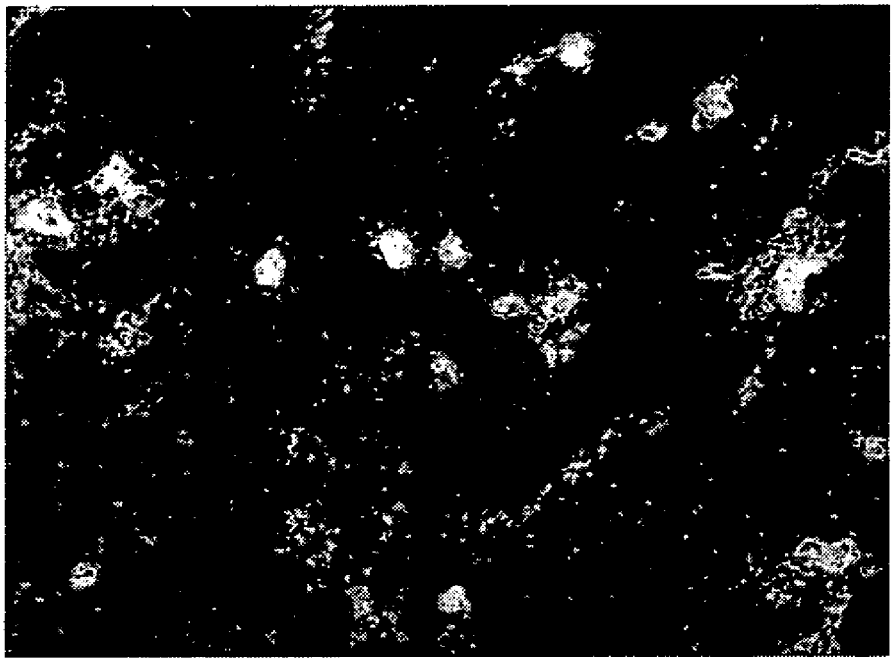
FIG. 26 is a representation of the microstructure of a sample No. 4 of a metal-matrix composite molded at a near liquidus temperature.

FIG. 26 is a representation of the microstructure of a sample No. 4 of a metal-matrix composite molded at a near liquidus temperature. FIG. 26 is scaled at 10 mm=100 μm. In the sample No. 4, the SiC includes coarsely graded particles.

Figure 27:
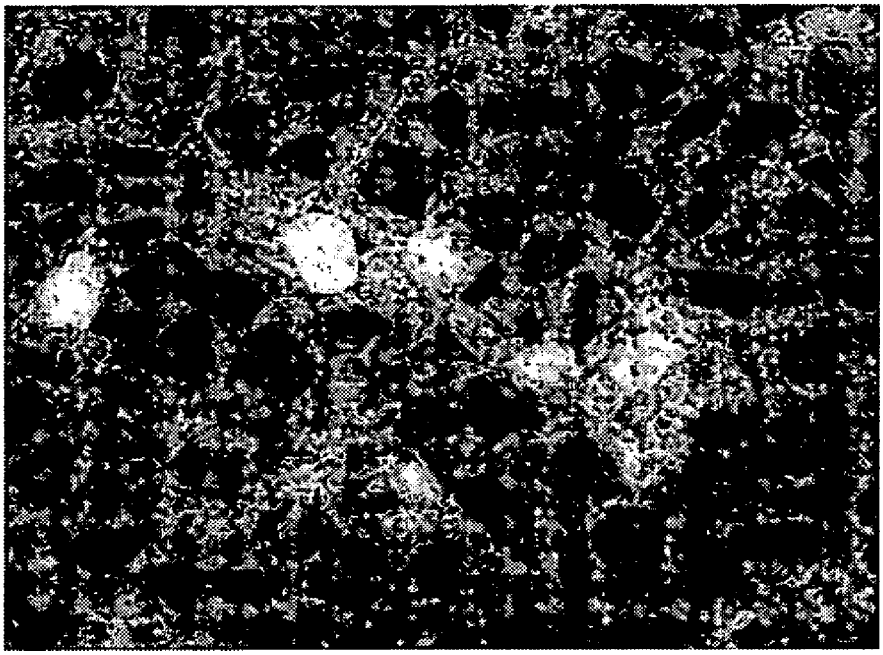
FIG. 27 is a representation of the microstructure of FIG. 26 in which details are shown at a higher magnification.

FIG. 27 is a representation of the microstructure of FIG. 26 in which details are shown at a higher magnification. FIG. 27 is scaled at 10 mm=50 μm.

Figure 28:
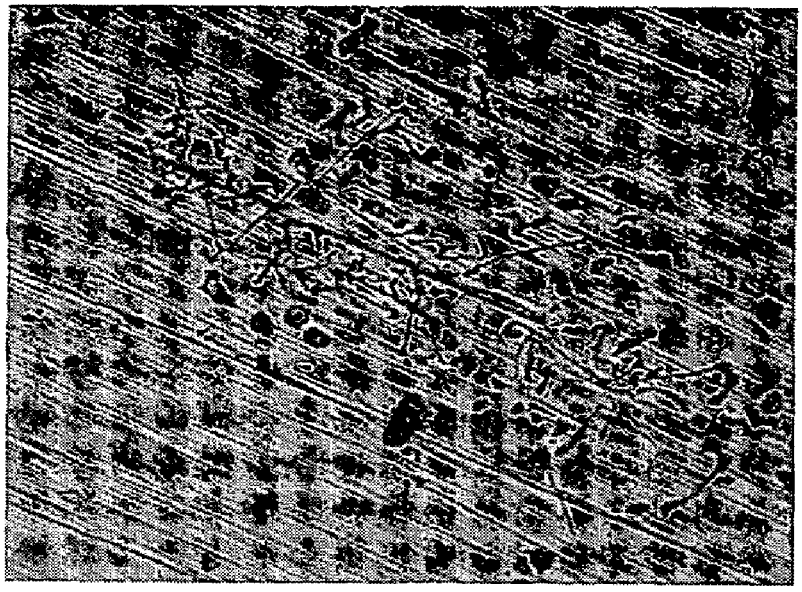
FIG. 28 is a representation of a microstructure of a sample No. 5 of a metal matrix composite molded at a near liquidus temperature.

FIG. 28 is a representation of a microstructure of a sample No. 5 of a metal matrix composite molded at a near liquidus temperature. FIG. 28 is scaled at 10 mm=200 μm. The metal-matrix composite of sample No. 5 included a metallic component and also included a reinforcement component that was chemically reactive, at least in part, with the metallic component. In sample No. 5, SiC reacted at higher temperature with a liquid fraction of Mg to form $Mg_2Si$ particles in a form of a "Chinese script".

Figure 29:
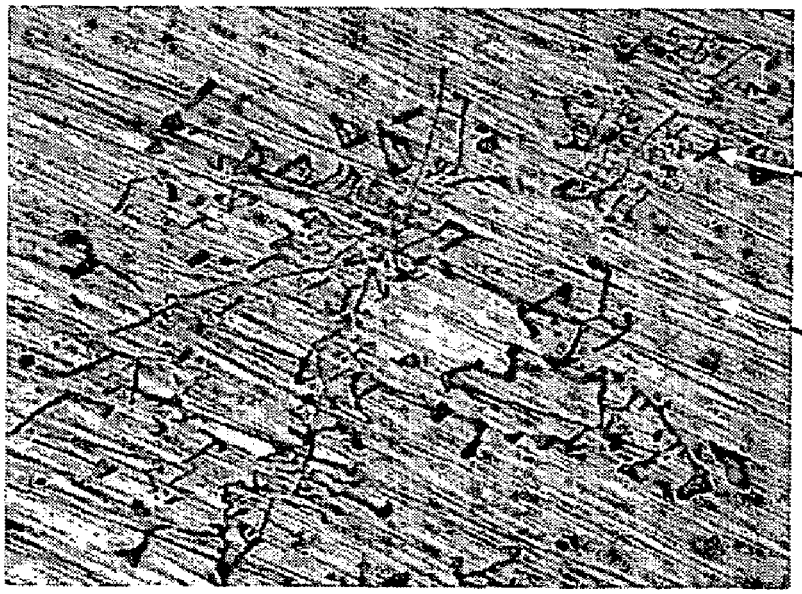
FIG. 29 is a representation of the microstructure of FIG. 28 in which details are shown at a higher magnification.

FIG. 29 is a representation of the microstructure of FIG. 28 in which another detail of the microstructure is shown. FIG. 29 is scaled at 10 mm=200 μm. Item 2902 represents an $Mg_2Si$ particle. Item 2904 represents a primary solid α—Mg.

According to another embodiment, a molded article includes a metallic component molded, at a near-liquidus temperature of the metallic component. Preferably, while the metallic component existed in a slurry state, the metallic component had a solid content up to 5%. Preferably, the metallic component molded was molded by a molding machine. Preferably, the metallic component molded was molded by a molding machine, and the molding machine included an injection molding machine.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. An injection-molding process for molding a metal alloy and a reinforcement component into a near net shape metal-matrix composite article including the following steps:

feeding the alloy and the reinforcement component into to an injection-molding apparatus having a heated barrel assembly;

transporting the alloy and the reinforcement component through a melt passageway in the barrel assembly with a screw feeder disposed therein and heating the alloy and the reinforcement component to a near-liquidus temperature of the alloy;

accumulating a volume of the alloy and the reinforcement component in an accumulation portion of the barrel assembly;

controlling the near-liquidus alloy temperature in the accumulation portion to maintain the alloy in a molten state having a maximum solids content of 3%; and injecting the alloy and the reinforcement component to fill a mold and cast at the near-liquidus temperature into the near net shape metal-matrix composite article having a fine equi-axed structure substantially without coarse directional dendrites.

2. An injection molding process according to claim 1 further including a step of applying a pressure to the slurry intermediate the steps of mold filling and final solidification.

3. An injection molding process according to claim 1 in which the alloy is selected from the following group: magnesium based alloys, aluminum based alloys, lead based alloys, zinc based alloys, bismuth based alloys.

4. An injection molding process according to claim 1 in which the alloy is fed in the form of mechanically comminuted chips.

5. An injection molding process according to claim 1 in which the alloy is fed in the form of metal rapidly solidified into granules.

6. An injection molding process according to claim 1 in which the alloy is a magnesium based alloy having a nominal composition known as AZ91D and the alloy is heated in the barrel to a temperature approaching 595° C.

7. An injection molding process according to claim 1 in which the alloy is a magnesium based alloy having a nominal composition known as AM60 and the alloy is heated in the barrel to a temperature approaching 615° C.

8. An injection molding process according to claim 1 in which the alloy is a magnesium based alloy having a nominal composition known as AJ52 and the alloy is heated in the barrel to a temperature approaching 616° C.

9. An injection molding process according to claim 1 in which the temperature of the alloy in the head is controlled within 2° C. of the liquidus temperature.

10. An injection molding process according to claim 1 in which the temperature of the alloy in the head is controlled with 1° C. of the liquidus temperature.

11. An injection molding process according to claim 1 in which any molten alloy is protected from oxidation by an inert gas.

12. An injection molding process according to claim 11 in which the inert gas is argon.

13. An injection molding process according to claim 1 in which the mold is adapted to form a near net shape having thin walls not exceeding 2 mm.

14. An injection molding process according to claim 1 in which controlling the near-liquidus alloy temperature in the accumulation portion maintains the alloy in a molten state having a maximum solids content of less than 2%.

* * * * *